US007599632B2

(12) United States Patent
Sato

(10) Patent No.: US 7,599,632 B2
(45) Date of Patent: Oct. 6, 2009

(54) IMAGE FORMING APPARATUS AND METHOD FOR FORMING IMAGES FOR CARRYING OUT DEVELOPMENT USING A LIGHT TONER AND A DARK TONER HAVING SUBSTANTIALLY THE SAME HUE

(75) Inventor: Akihiko Sato, Katsushika-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/266,460

(22) Filed: Nov. 6, 2008

(65) Prior Publication Data

US 2009/0129803 A1 May 21, 2009

Related U.S. Application Data

(63) Continuation of application No. 11/292,779, filed on Dec. 2, 2005, now Pat. No. 7,450,866.

(30) Foreign Application Priority Data

Dec. 9, 2004 (JP) ..... 2004-357133

(51) Int. Cl.
*G03G 15/00* (2006.01)

(52) U.S. Cl. ..... 399/15; 399/49

(58) Field of Classification Search ..... 399/15, 399/49, 53, 72

See application file for complete search history.

(56) References Cited

U.S. PATENT DOCUMENTS

| | | | | |
|---|---|---|---|---|
| 6,498,910 | B2 | 12/2002 | Haneda | |
| 6,819,902 | B2 | 11/2004 | Toyohara et al. | |
| 7,206,531 | B2 | 4/2007 | Suzuki et al. | |
| 7,209,673 | B2 | 4/2007 | Suzuki et al. | |
| 7,310,483 | B2 | 12/2007 | Mizuno | |
| 7,450,866 | B2 * | 11/2008 | Sato | 399/15 |

FOREIGN PATENT DOCUMENTS

| | | |
|---|---|---|
| JP | 2001-290319 A | 10/2001 |
| JP | 2004-145137 A | 5/2004 |

* cited by examiner

*Primary Examiner*—William J Royer
(74) *Attorney, Agent, or Firm*—Canon U.S.A. Inc., I.P. Division

(57) ABSTRACT

An image forming apparatus configured to carry out development using a light toner and a dark toner having substantially the same hue, includes a pattern forming unit configured to form a pattern using a dark toner and a light toner, a pattern reading unit configured to read the density of the pattern formed on a sheet of recording paper after the pattern has been fixed, and a gradation correction unit configured to correct the gradation characteristics of image data for the light toner by changing the slope of the gradation characteristics with zero level as a base point. The changing of the slope is based on the density characteristics of the pattern read by the pattern reading unit and the ratio of the amounts of the light toner and the dark toner that have been used.

1 Claim, 18 Drawing Sheets

IMAGE FORMING APPARATUS AND METHOD FOR FORMING IMAGES FOR CARRYING OUT DEVELOPMENT USING A LIGHT TONER AND A DARK TONER HAVING SUBSTANTIALLY THE SAME HUE

CROSS REFERENCE TO RELATED APPLICATIONS

This application is a Continuation of U.S. application Ser. No. 11/292,779 filed Dec. 2, 2005 now U.S. Pat. No. 7,450,866 which claims the benefit of Japanese Application No. 2004-357133 filed Dec. 9, 2004, both of which are hereby incorporated by reference herein in its entirety.

BACKGROUND OF THE INVENTION

1. Field of the Invention

The present invention relates to an image forming apparatus configured to form images using toners having substantially the same hue but different densities and a method for controlling the image forming apparatus.

2. Description of the Related Art

An image forming apparatus configured to form images using electrography includes a charging unit capable of uniformly charging a photosensitive surface of a photosensitive drum. The image forming apparatus also includes a latent-image forming apparatus configured to form latent images corresponding to image information on the charged photosensitive surface of the photosensitive drum and a developing unit configured to develop the latent images with developers. In addition, the image forming apparatus includes a transferring unit configured to transfer the developed latent images onto a recording material and a fixing unit configured to fix the transferred latent image on the recording material.

In general, for the developers (toners), one type of toner having a predetermined density is used for each color, i.e., cyan, magenta, yellow, or black. However, when toners having the same density are used, the amount of toner used in the highlighted areas of an image (i.e., low density areas) is reduced. For this reason, there are difficulties in the reproducibility of the gradation (density gradation) of the image data. Recently, the need for high quality image formation has grown. To meet this need, an image forming apparatus that uses a greater number of toner colors compared with previously known image forming apparatuses capable of forming four-color images has been proposed. More specifically, an electrographic image forming apparatus using toners having substantially the same hue but different densities is described in Japanese Patent Laid-Open Nos. 2001-290319 and 2004-145137.

Many of such image forming apparatuses use six different toner colors, i.e., the four colors of cyan, magenta, yellow, and black and two additional colors of light cyan and light magenta. The colorants included in light cyan and light magenta toners have the same spectral characteristics as those of regular cyan and magenta toners, respectively, but the amount of colorant included in the lighter toners is smaller. Hereinafter, regular cyan and magenta toners are referred to as 'dark toners,' and light cyan and light magenta toners are referred to as 'light toners.' Moreover, an image signal controlling the output of a dark toner is referred to as a 'dark toner image signal,' and an image signal controlling the output of a light toner is referred to as a 'light toner image signal.'

FIG. 19 is a graph showing the relationships among the color density indicated by an input signal corresponding to an input image, the amounts of dark and light toners applied to a sheet of recording paper, and the output densities of dark and light toners. A solid line T1 and a dotted line T2, shown in FIG. 19, represent the amount of light toner and dark toner, respectively, applied on a sheet of recording paper to reproduce the color density indicated by an input signal corresponding to an input image. A straight line m represents the optimal output density corresponding to the color density indicated by an input signal corresponding to an input image. The amounts of dark toner and light toner applied to a sheet of recording paper to reproduce the color density indicated by an input signal corresponding to an input image are determined so that the graph representing the relationship between the density of the input image and the density of an output image formed with dark and light toners has an optimal line shape. When the maximum density of an image corresponding to an input image signal is set as 1.8, areas ranging from highlighted areas (low density areas) to intermediate areas are formed only with light toner so as to reduce the granulated effect of the image. Areas ranging from intermediate areas to high density areas having a density of 0.9 or more are formed with both dark toner and light toner wherein as the density increases the amount of light toner used is reduced and the amount of dark toner used is increased so as to reduce the total amount of toners applied on the surface of the recording paper.

However, when the output characteristics of dark and light toners are changed for the image forming apparatus configured to form images using dark and light toners, the problems identified below may occur.

When resistance of the surface layer of the photosensitive drum and the triboelectricity of the toners decrease because of the environment and/or conditions of the image forming apparatus, the contrast voltage $V_{cont}$ decreases. As a result, the amount of toners attached to the surface of a sheet of the recording paper changes, causing the output density to be reduced.

More specifically, a curved line 1 in FIG. 19 represents a reduction in the amount of dark toner applied to a sheet of recording paper. The output density at this time is represented by a curved line n. As is apparent from the curved line n, the output density suddenly changes in the area having an intermediate density (i.e., in the area where the density of the image is around 0.9) where dark toner starts to be added for image formation. Therefore, images having areas with intermediate densities may exhibit an unsmooth change in gradation and/or include false outlines.

SUMMARY OF THE INVENTION

According to an aspect of the present invention, an image forming apparatus addresses the above-identified problems and is capable of preventing the generation of false outlines in a halftone area by preventing a significant difference in densities at the border areas of the dark toner areas and the light toner areas when developing an image using a dark toner and a light toner having substantially the same hue. In this way, the image forming apparatus is capable of steadily and stably forming high quality images.

According to an aspect of the present invention, an image forming apparatus configured to carry out development using a light toner and a dark toner having substantially the same hue includes a pattern forming unit configured to form a pattern using a dark toner and a light toner, a pattern reading unit configured to read the density of the pattern formed on a sheet of recording paper after the pattern has been fixed, and a gradation correction unit configured to correct the gradation characteristics of image data for a light toner by changing the slope of the gradation characteristics with zero level as a base point. The changing of the slope is based on the density characteristics of the pattern read by the pattern reading unit and the ratio of the amounts of the light toner and the dark toner that have been used.

According to another aspect of the present invention, an image forming apparatus configured to carry out development using a light toner and a dark toner having substantially the same hue includes a pattern forming unit configured to form a pattern using a dark toner and a light toner, a pattern reading unit configured to read the density of the pattern formed on a sheet of recording paper after the pattern has been fixed, and a gradation correction unit configured to correct the gradation characteristics of image data for the dark toner by changing the slope of the gradation characteristics with the maximum density level as a base point. The changing of the slope is based on the density characteristics of the pattern read by the pattern reading unit and the ratio of the amounts of the light toner and the dark toner that have been used.

According to another aspect of the present invention, an image forming apparatus configured to carry out development using a light toner and a dark toner having substantially the same hue includes a pattern forming unit configured to form a pattern using a dark toner and a light toner, a pattern reading unit configured to read the density of the pattern formed on a sheet of recording paper after the pattern has been fixed, and a gradation correction unit configured to correct the gradation characteristics of image data for the light toner by changing the slope of the gradation characteristics with zero level as a base point and for correcting the gradation characteristics of image data for the dark toner by changing the slope of the gradation characteristics with the maximum density level as a base point. The changing of the slopes is based on the density characteristics of the pattern read by the pattern reading unit and the ratio of the amounts of the light toner and the dark toner that have been used.

According to yet another aspect of the present invention, a method for forming an image includes a pattern forming step of forming a pattern using a dark toner and a light toner, a reading step of reading the density of the pattern formed on a sheet of recording paper after the pattern has been fixed, and a correcting step of correcting the gradation characteristics of image data for the light toner by changing the slope of the gradation characteristics with zero level as a base point. The changing of the slope is based on the density characteristics of the pattern read in the reading step and the ratio of the amounts of the light toner and the dark toner that have been used.

According to still another aspect of the present invention, a method for forming an image includes a pattern forming step of forming a pattern using a dark toner and a light toner, a reading step of reading the density of the pattern formed on a sheet of recording paper after the pattern has been fixed, and a correcting step of correcting the gradation characteristics of image data for the dark toner by changing the slope of the gradation characteristics with the maximum density level as a base point. The changing of the slope is based on the density characteristics of the pattern read in the reading step and the ratio of the amounts of the light toner and the dark toner that have been used.

Further features of the present invention will become apparent from the following description of exemplary embodiments (with reference to the attached drawings).

DESCRIPTION OF THE EMBODIMENTS

Exemplary embodiments of the present invention will be described below with reference to the attached drawings. The embodiments should not be construed as restricting the invention in the claims. All the combinations of features disclosed in the embodiments are not necessarily essential to the invention.

First Embodiment

Figure 1:
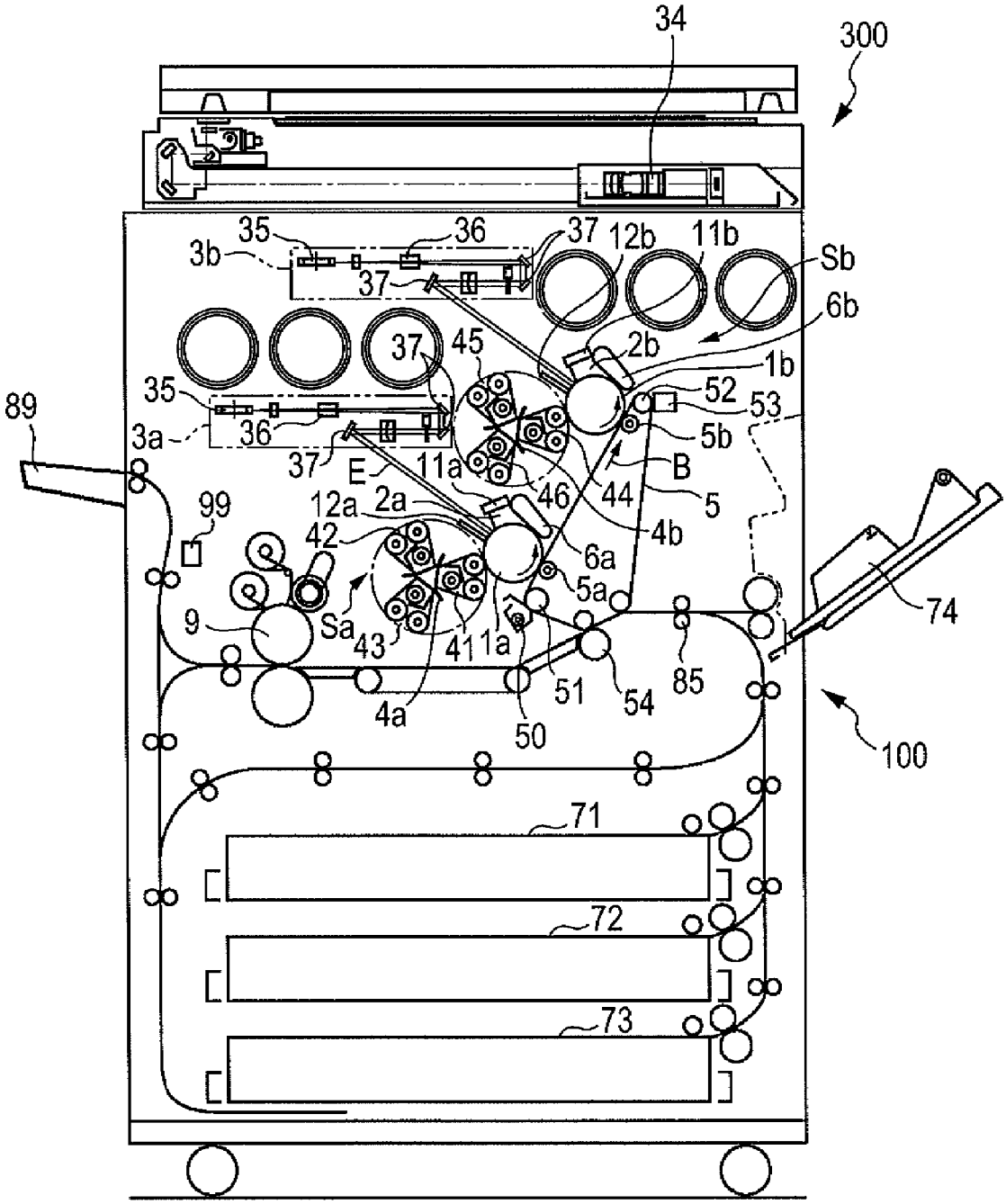
FIG. 1 is a plan view showing the structure of an electrographic image forming apparatus according to an embodiment of the present invention.

FIG. 1 is a plan view showing the structure of an electrographic color image forming apparatus 100 according to a first embodiment. This color image forming apparatus 100 is configured to form images by electrography using a dark toner and a light toner having substantially the same hue but different densities.

The color image forming apparatus 100 includes six developing units 41, 42, 43, 44, 45, and 46. The developing unit 41 contains a light cyan toner, the developing unit 42 contains a yellow toner, the developing unit 43 contains a magenta toner, the developing unit 44 contains a light magenta toner, the developing unit 45 contains a cyan toner, and the developing unit 46 contains a black toner.

Toners, whose base substances are resin and color component (colorants), are defined as having substantially the same hue but different densities when the colorants included in the toners have the same spectrographic characteristics but are included in different quantities. A light toner is a toner that has a relatively low density among the two toners having the same hue.

Toners having substantially the same hue, as described above, are toners having color components (colorants) that have the same spectrographic characteristics. However, so long as the toners can be perceived as generally the same color, such as 'magenta,' 'cyan,' 'yellow,' or 'black,' the hues of these toners may be defined as being substantially the same.

According to this embodiment, for a toner having substantially the same hue and a low density (i.e., light toner), the optical density of the toner after being fixed is less than 1.0 when the amount of toner applied onto a recording material is 0.5 mg/cm$^2$, whereas for a dark toner, the optical density of the toner after being fixed is 1.0 or more when the amount of toner applied onto a recording material is 0.5 mg/cm$^2$.

According to this embodiment, the colorant of a dark toner is adjusted so that the optical density after the toner is fixed is 1.6 when the amount of toner applied onto a recording material is 0.5 mg/cm$^2$, where as the colorant of a light toner is adjusted so that the optical density after the toner is fixed is 0.8 when the amount of toner applied onto a recording material is 0.5 mg/cm$^2$. The dark and light toners of the same hue are mixed appropriately to reproduce a color gradation.

The color image forming apparatus 100 includes two drum-shaped image bearing members, i.e., a first photosensitive drum 1*a* and a second photosensitive drum 1*b*. The photosensitive drums 1*a* and 1*b* are rotationally driven in the directions indicated by arrows.

Around the first photosensitive drum 1*a*, a pre-exposure lamp 11*a*, a corona charging unit 2*a*, a laser exposing unit 3*a*, a voltage sensor 12*a*, a development rotary unit 4*a* including the developing units 41, 42, and 43, a primary transfer roller 5*a*, and a cleaning unit 6*a* are disposed. The first photosensitive drum 1*a* and the peripheral units are collectively referred to as a first image forming unit Sa. The same units are disposed around the second photosensitive drum 1*b*, and, similarly, the second photosensitive drum 1*b* and the peripheral units are collectively referred to as a second image forming unit Sb. The image forming units Sa and Sb have substantially the same structure (shape) so as to reduce production cost. For example, the structure and shape of the developing units are substantially the same. In this way, the developing units 41 to 46 are interchangeable.

According to this embodiment, an intermediate transfer belt 5, which is a belt-shaped intermediate transfer body, is disposed adjacent to the photosensitive drums 1*a* and 1*b* so that the intermediate transfer belt 5 is wound around the primary transfer roller 5*a* and a primary transfer roller 5*b*, which function as primary transfer mechanisms, a driving roller 51, and a roller 52. The primary transfer rollers 5*a* and 5*b* are disposed in contact with the photosensitive drums 1*a* and 1*b* to form primary transfer sections. The intermediate transfer belt 5 is passed through a nip between a secondary transfer roller 54 and another roller disposed opposite to the secondary transfer roller 54 to form a secondary transfer section. The secondary transfer roller 54 can be moved into contact with or apart from the intermediate transfer belt 5. A cleaner 50 for removing toner remaining on the intermediate transfer belt 5 after transfer is provided in a manner such that the cleaner 50 can be moved into contact with or apart from the intermediate transfer belt 5.

Now the image forming operation of the above-described color image forming apparatus 100 will be described.

A start signal for image forming based on an image signal corresponding to an image of a document read by a reader unit 300 is generated. The color image forming apparatus 100 receives image signals from a computer or a facsimile in addition to the image signal from the reader unit 300. However, here, image forming operation based only on an image signal sent from the reader unit 300 will be described.

Subsequently, the photosensitive drums 1*a* and 1*b* of the image forming units Sa and Sb, respectively, that are rotationally driven at a predetermined processing speed are electrically neutralized by the pre-exposure lamps 11*a* and 11*b*, respectively, and uniformly and negatively charged by the corona charging units 2*a* and 2*b*, respectively. The laser exposing units 3*a* and 3*b* form electrostatic latent images of the different colors by emitting laser beams from a semiconductor laser 36 corresponding to color-separated image signals input from the reader unit 300 onto the photosensitive drums 1*a* and 1*b* via a polygon mirror 35, reflective mirrors 37, and other components.

The subsequent operations in a high quality color mode and a regular color mode will be described below.

The operations in a high quality color mode (i.e., when an image is formed using six colors) will be described below.

The development rotary unit 4*a* is rotated so that the developing unit 41 comes into contact with an electrostatic latent image formed on the first photosensitive drum 1*a*. At this time, a development bias having the same polarity as the charge of the first photosensitive drum 1*a* (i.e., a negative bias) is applied to the developing unit 41. In this way, a light cyan toner is applied on the first photosensitive drum 1*a*, visualizing the latent image into a toner image.

Primary transfer of the light cyan toner image on the first photosensitive drum 1*a* onto the intermediate transfer belt 5 is carried out at the primary transfer section between the first photosensitive drum 1*a* and the primary transfer roller 5*a* by the primary transfer roller 5*a* having a primary transfer bias (a polarity opposite to the toner (i.e., a positive bias)).

Similar to the operation of the image forming apparatus of the first photosensitive drum 1*a*, a light magenta latent image is formed on the second photosensitive drum 1*b* by the corona charging unit 2*b* and the laser exposing unit 3*b*, which constitute a primary charging unit. A light magenta image is developed by rotating the development rotary unit 4*b* to move the developing unit 44, containing a light magenta toner, into contact with the second photosensitive drum 1*b*. The light magenta image on the second photosensitive drum 1*b* is transferred onto the intermediate transfer belt 5 by a transfer bias applied to the downstream primary transfer roller 5*b*.

As the intermediate transfer belt 5 rotates in a direction indicated by an arrow B, the image on the intermediate transfer belt 5 moves through the space between the intermediate transfer belt 5 and the secondary transfer roller 54 and through the space between the intermediate transfer belt 5 and the cleaner 50. Then, finally, the image returns to the primary transfer section.

By rotating the development rotary unit 4*a*, the developing unit 43 containing a yellow toner is moved into contact with the first photosensitive drum 1*a* to form a yellow image. Then, the yellow image is transferred onto the intermediate transfer belt 5. The image on the intermediate transfer belt 5 moves downstream to the second photosensitive drum 1*b* to form a cyan image in a manner similar to the yellow image.

The above-described operation is repeated to transfer magenta and black toner images onto the intermediate transfer belt 5. Once all colors are transferred onto the intermediate transfer belt 5, the full-color toner image is moved to the secondary transfer section. When the first edge of the full-color toner image on the intermediate transfer belt 5 reaches the nip between a roller opposing the secondary transfer roller 54 and the secondary transfer roller 54, a transfer material (a sheet of recording paper) is selected from one of paper-feeding cassettes 71 to 74 and is fed through a conveying path. The transfer material is conveyed to the secondary transfer section by a resist roller 85. Secondary transfer of the full-color toner image is carried out by the secondary transfer roller 54 receiving a secondary bias (a polarity opposite to the toner (i.e., a positive bias)) to transfer the full-color toner image at once onto the transfer material conveyed to the secondary transfer section. The toner remaining on the intermediate transfer belt 5 after transfer is cleaned by moving the cleaner 50 into contact with the intermediate transfer belt 5 after the secondary transfer.

The transfer material having the full-color toner image is conveyed to a fixing unit 9 where the toner image on the transfer material is thermally fixed onto the surface of the transfer material by heat and pressure applied at the fixing nip between a fixing roller and a pressurization roller, respectively. Subsequently, the transfer material is ejected into an ejection tray 89 disposed at the upper surface of the color image forming apparatus 100 by an ejection roller. Then, the image forming operation is completed.

Next, the operations in a regular color mode (i.e., when an image is formed using four colors) not using light toners will be described below.

A yellow latent image is formed on the first photosensitive drum 1*a* by the corona charging unit 2*a* and the laser exposing unit 3*a*, which constitute a primary charging unit. By rotating the development rotary unit 4*a*, the light cyan developing unit 41 is sent forward and the yellow developing unit 43 is moved into contact with the first photosensitive drum 1*a* to develop a yellow image. The yellow image on the first photosensitive drum 1*a* is transferred onto the intermediate transfer belt 5 by the transfer bias applied to the primary transfer roller 5*a*.

Similar to the operation of the image forming apparatus of the first photosensitive drum 1*a*, a cyan latent image is formed on the second photosensitive drum 1*b* by the corona charging unit 2*b* and the laser exposing unit 3*b*, which also constitute a primary charging unit. By rotating the development rotary unit 4*b*, the light magenta developing unit 44 is sent forward and the cyan developing unit 46 is moved into contact with the second photosensitive drum 1*b* to develop a cyan image. The cyan image on the second photosensitive drum 1*b* is transferred onto the intermediate transfer belt 5 by the transfer bias applied to the primary transfer roller 5*b*.

As the intermediate transfer belt 5 rotates in a direction indicated by an arrow B, the image on the intermediate transfer belt 5 moves through the space between the intermediate transfer belt 5 and the secondary transfer roller 54 and through the space between the intermediate transfer belt 5 and the cleaner 50. Then, finally, the image returns to the primary transfer section.

By rotating the development rotary unit 4*a*, the magenta developing unit 42 is moved into contact with the first photosensitive drum 1*a* to form a magenta image and to transfer the image onto the intermediate transfer belt 5. The magenta image on the intermediate transfer belt 5 moves to the second photosensitive drum 1*b* to form a black image in a manner similar to the magenta image.

After transferring the four images of four different colors onto the intermediate transfer belt 5 by carrying out the above-described operations, the four-color image is moved to the secondary transfer section where secondary transfer roller 54 comes into contact with the intermediate transfer belt 5. At the secondary transfer section, a transfer bias applied to the secondary transfer roller 54 causes the image to be transferred onto a transfer material. Then, the image on the transfer material is fixed by the fixing unit 9. The toner remaining on the intermediate transfer belt 5 after transfer is cleaned by moving the cleaner 50 into contact with the intermediate transfer belt 5 after the secondary transfer is carried out.

Since the color image forming apparatus 100 includes two development rotary units 4*a* and 4*b*, as described above, the six-color image can be formed in the high-quality color mode without reducing throughput of the color image forming apparatus 100 compared to known rotary type multi-color image forming apparatuses and without increasing the size and production cost of the color image forming apparatus 100 compared to those of known inline type image forming apparatuses.

Moreover, a four-color image (not using light toners) can be formed in the regular color mode without using the developing units for light toners and faster than the images formed by known multi-color image forming apparatuses having only one development rotary unit.

Figure 16:
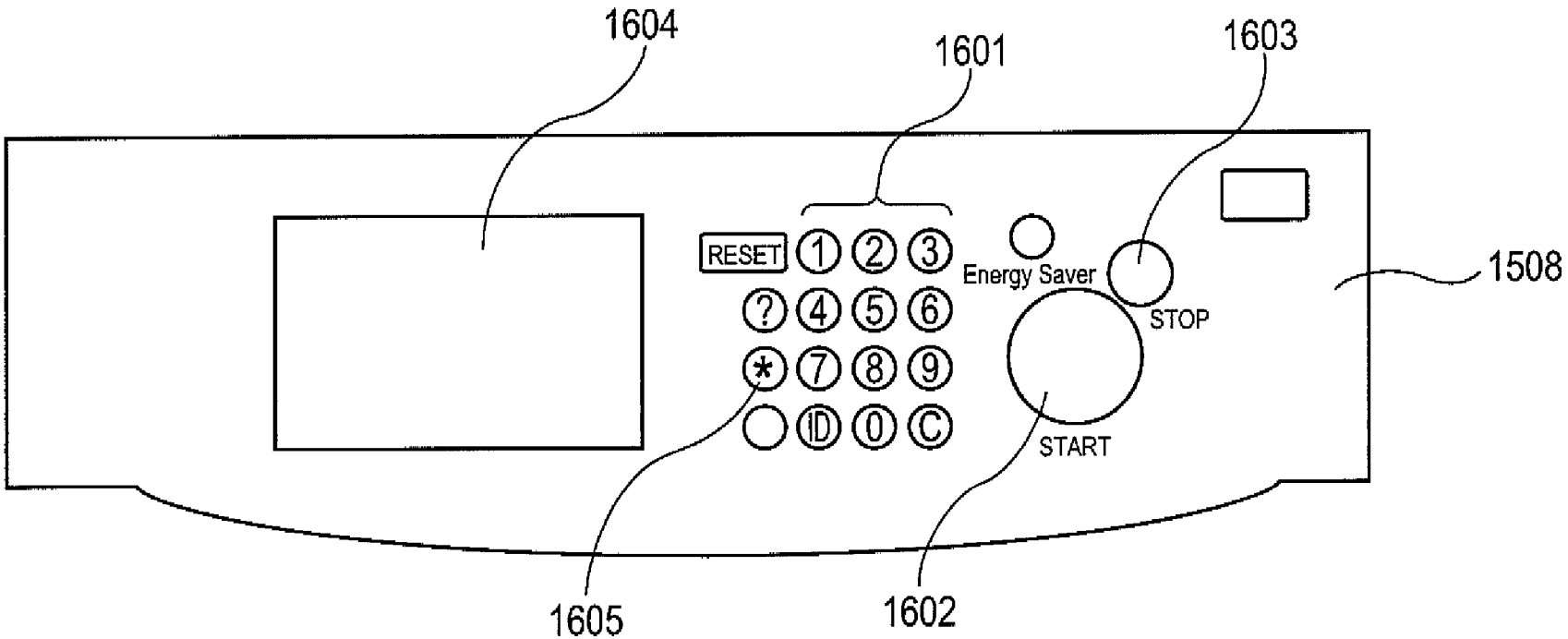
FIG. 16 illustrates an operation panel of an image forming apparatus according to an embodiment.

The switching between the high quality color mode (for forming a six-color image) and the regular color mode (for forming a four-color image) is controlled by the user at an operating unit 1508 (FIG. 16). The operating unit 1508 will be described below.

The color image forming apparatus 100 has an automatic adjustment function for adjusting the voltage values of the corona charging units 2*a* and 2*b* of the image forming units Sa and Sb and the primary transfer rollers 5*a* and 5*b* so as to obtain high quality images. The automatic adjustment function includes DMax control for determining the maximum density of the image so as to determine the gradation of a toner image and gradation correction control for providing gradation. A patch image having a predetermined density and size is produced to carry out the automatic adjustment function. This patch image is read by a patch detection sensor 53. In the automatic adjustment function, the density of a patch image of each color toner is detected by the patch detection sensor 53, and then the density of each color toner in a toner image is adjusted to the optimum density.

The patch detection sensor 53 senses a patch image on an intermediate transfer body or a drum and then detects the patch image. The patch detection sensor 53 is not capable of controlling the change in color balance of the image after the image is transferred and/or fixed on a recording material. The color balance may change due to the efficiency of transferring the toner image onto a recording material or the heat and pressure applied during fixing. This change in color balance cannot be compensated for by controlling the density of the toner on the basis of the detection results of the patch detection sensor 53.

Accordingly, a post-fixing sensor 99 is provided to detect the density and/or the color of the single-color gradation patches of cyan, magenta, yellow, black, light cyan, and light magenta and/or a patch of a mixture of cyan, magenta, and yellow formed on a recording material after fixing.

In the color image forming apparatus 100, the density or the color of an output image formed on a recording material can be controlled by the post-fixing sensor 99 sending its detection results as a feedback to a calibration table used for correcting the exposure light at the image forming units Sa and Sb, the process condition, and the density/gradation characteristics.

Figure 2:
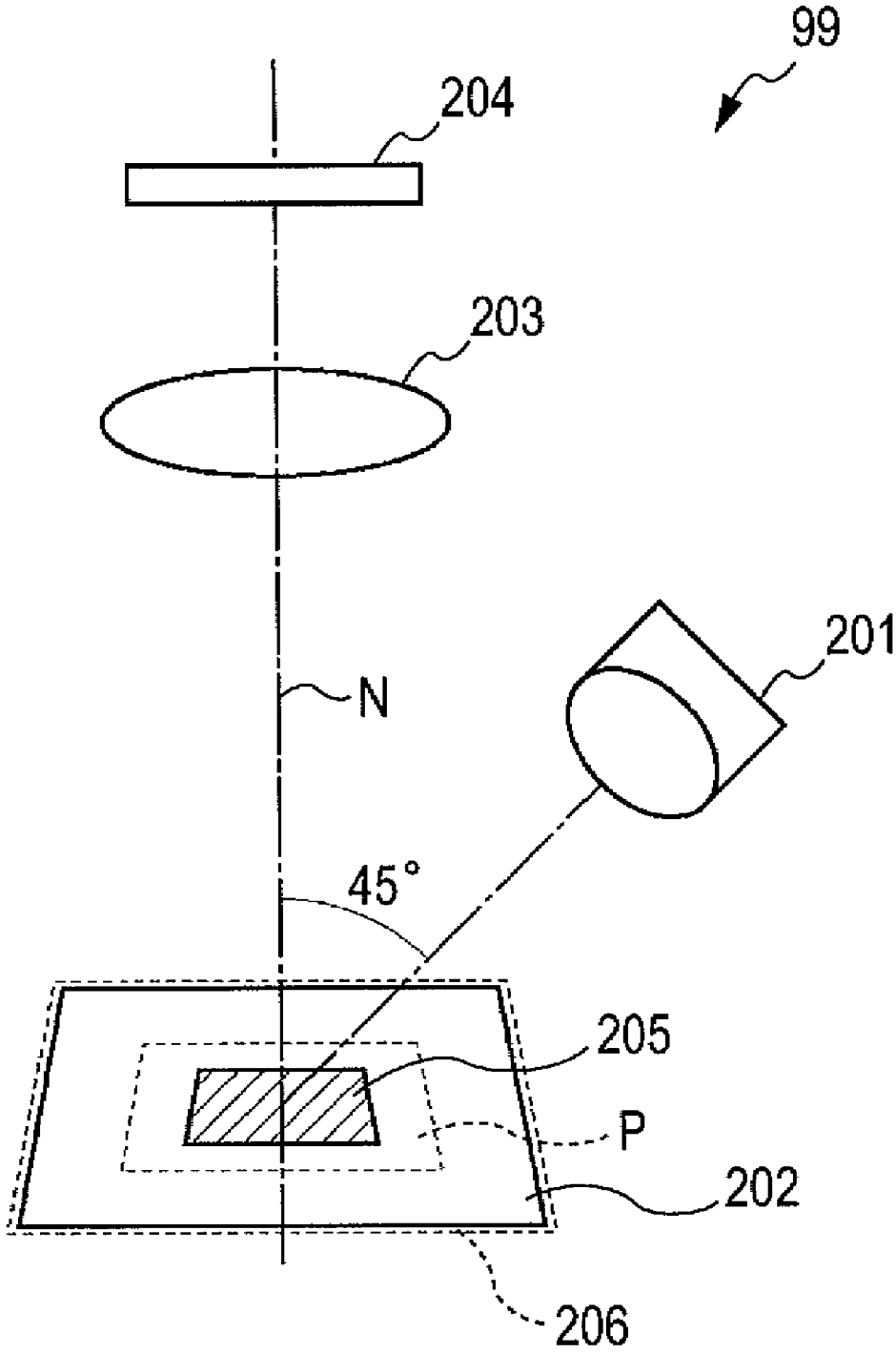
FIG. 2 shows the detailed structure of a post-fixing sensor according to an embodiment and its periphery.

FIG. 2 illustrates the structure of the post-fixing sensor 99 of the color image forming apparatus 100 shown in FIG. 1. The light source for the post-fixing sensor 99 is a light emitting diode (LED) 201 capable of emitting light having a peak wavelength of 400 nm to 700 nm in accordance with the color of the pattern image to be measured. The LED 201 is disposed at a 45° angle to a normal line N of an opening 202 for measurement and emits light onto a pattern 205 formed on a sheet of recording paper P delivered to the opening 202. Above the opening 202 along the normal line N, an image forming lens 203 and a light receiving unit 204 are disposed. The light emitted from the LED 201 is reflected at the pattern 205 formed on the sheet of recording paper P. The image forming lens 203 focuses the reflected light component parallel to the normal line N to form an image on the light receiving surface of the light receiving unit 204. The light receiving unit 204 is constituted of arrays of photoelectric transducers, such as photodiodes. A glass plate 206 is interposed between the light receiving unit 204 and the sheet of recording paper P so that the sheet of recording paper P is conveyed while it is closely attached to the glass plate 206. In this way, measurement can be carried out while the optical length to the surface of the sheet of recording paper P is maintained at a constant value.

Figure 15:
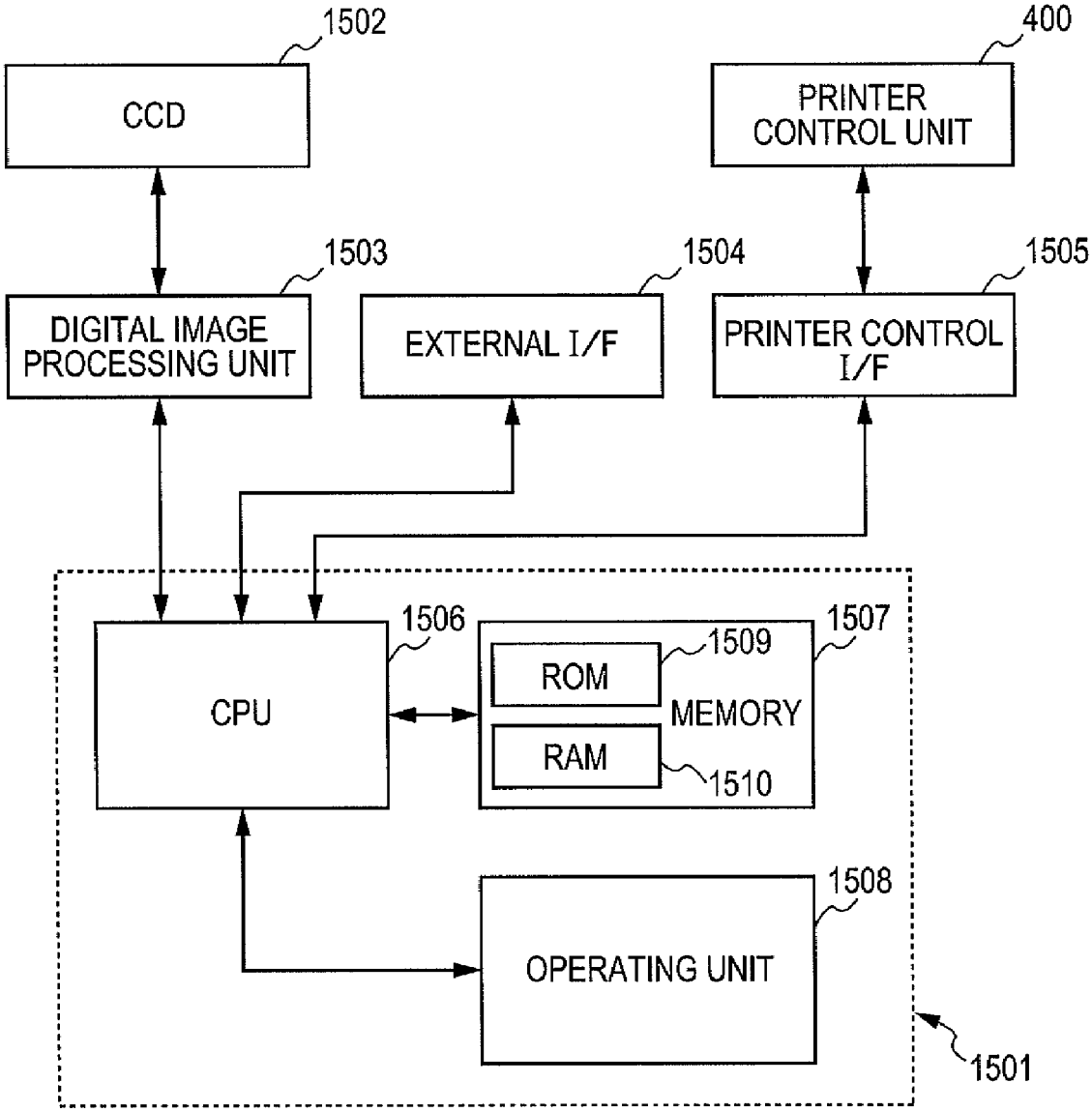
FIG. 15 is a block diagram showing the overall structure of a control circuit according to an embodiment.

FIG. 15 is a block diagram showing the main components of a control unit 1501 configured to control the operation of the color image forming apparatus 100. The control unit 1501 includes a memory 1507, an operating unit 1508 and a central processing unit (CPU) 1506 having interfaces (I/Fs) for communicating and controlling a digital image processing unit 1503, a printer control I/F 1505 and an external I/F 1504. The digital image processing unit 1503 includes an interface for communicating with a charge-coupled device (CCD) 1502). The printer control I/F includes an interface for communicating with a printer control unit 400. The memory 1507 is constituted of a random access memory (RAM) 1510 used as a work area for the CPU 1506 and a read only memory (ROM) 1509 for storing control programs of the CPU 1506. The ROM 1509 stores control programs for executing various operation modes, such as an automatic color selection (ACS) mode for automatically switching color image formation and monochrome image formation, a high quality color mode, a regular color mode, and a monochrome image formation mode. The ROM 1509 stores control programs configured to control the entire color image forming apparatus 100. The operating unit 1508 includes a liquid crystal display (LCD) with a touch panel that can be operated by the user to input instructions for processes and actions and displays information concerning various processes and various warnings.

FIG. 16 illustrates an exemplary structure of the operating unit 1508. The operating unit 1508 shown in FIG. 16 includes a ten key pad 1601, a start key 1602, a stop key 1603, an LCD 1604, and a user mode key 1605. The ten key pad 1601 is operated by the user to input the number of copies to produce and/or the displacement of the image to be copied. The start key 1602 is pushed by the user to start a copy job. The stop key 1603 is pushed by the user to stop an already-started copy job. The LCD 1604 is a display unit configured to display the operation status of the color image forming apparatus 100. The LCD 1604 has a panel switch that can be operated by the user to set the copy job mode.

The user mode key 1605 is pushed by the user to display the user mode screen on the LCD 1604. The user mode screen allows the user to set the specifications for the functions of the color image forming apparatus 100. If the user does not explicitly select one of the light quality color mode, the regular color mode, and the monochrome image forming mode (which may also be referred to a monochrome mode), the color image forming apparatus 100 is set to the ACS mode in which the image to be formed is automatically detected and color image formation or monochrome image formation is selected.

The user can select the settings for the standard operation of the color image forming apparatus 100. The settings may include settings for determining whether or not the longitudinal and lateral lengths of a sheet of paper are to be input by the user, in the monochrome image forming mode, when the size of the sheet of paper is irregular. Moreover, the settings may include settings for determining whether or not the longitudinal and lateral lengths of a sheet of paper are to be input by the user as initial settings or input by the user when the color document to be read is detected, in the ACS mode, when the size of the sheet of paper is irregular.

By operating the operating unit 1508, the user can start the adjustment mode according to this embodiment so as to control the density and/or gradation of an output image formed on a recording material.

Figure 18:
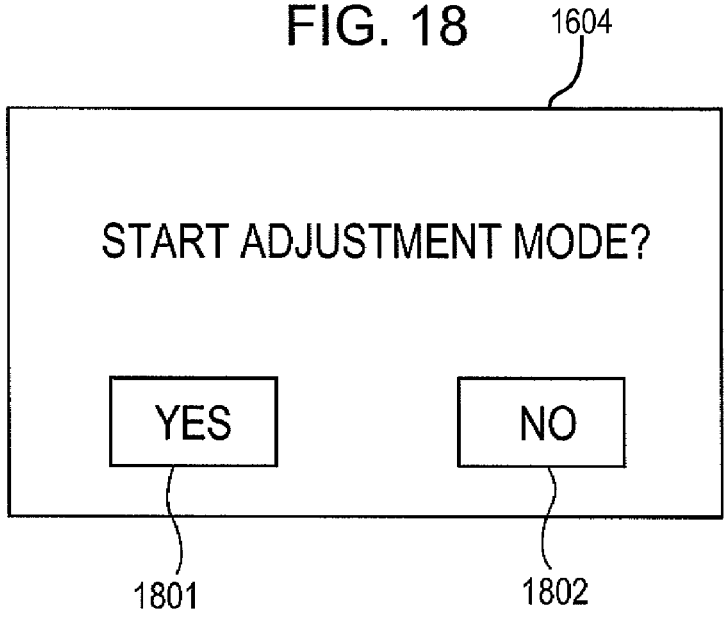
FIG. 18 illustrates a display screen of an operation panel at an adjusting state according to an embodiment.
Figure 19:
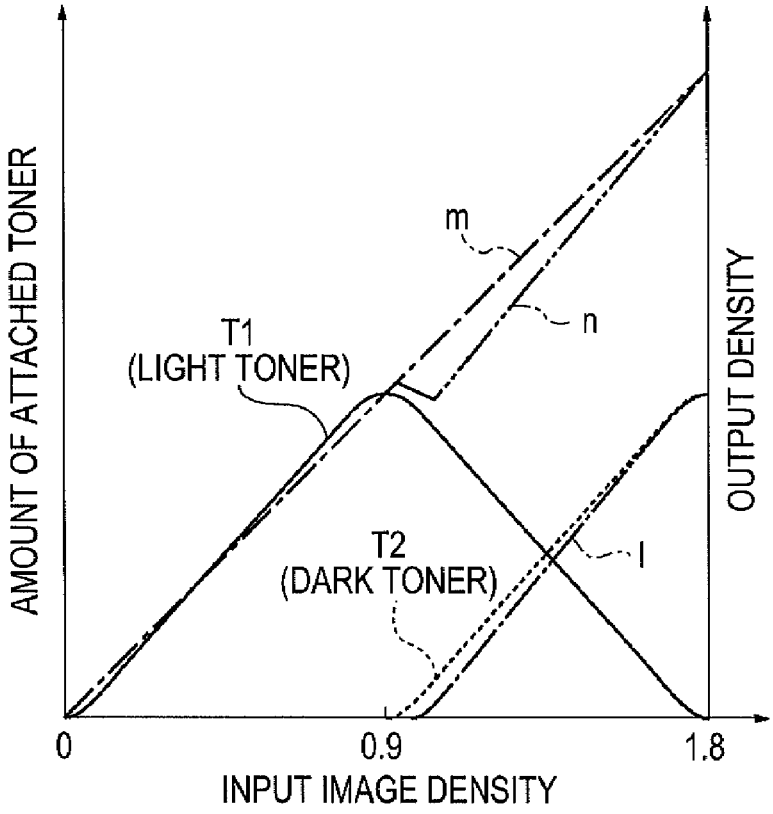
FIG. 19 is a graph showing the relationship of the densities of images corresponding to a dark toner input image signal and a light toner input image signal, the amount of toner used, and output densities.

FIG. 18 illustrates an exemplary display screen on the LCD 1604 in the adjustment mode. This screen is displayed when the user mode key 1605 on the screen is pressed to display the user mode screen on the LCD 1604 and then the adjustment mode is selected. If a YES button 1801 in the screen is selected, the adjustment mode begins, whereas, if a NO button 1802 is selected, the screen returns to the user mode screen.

Figure 17:
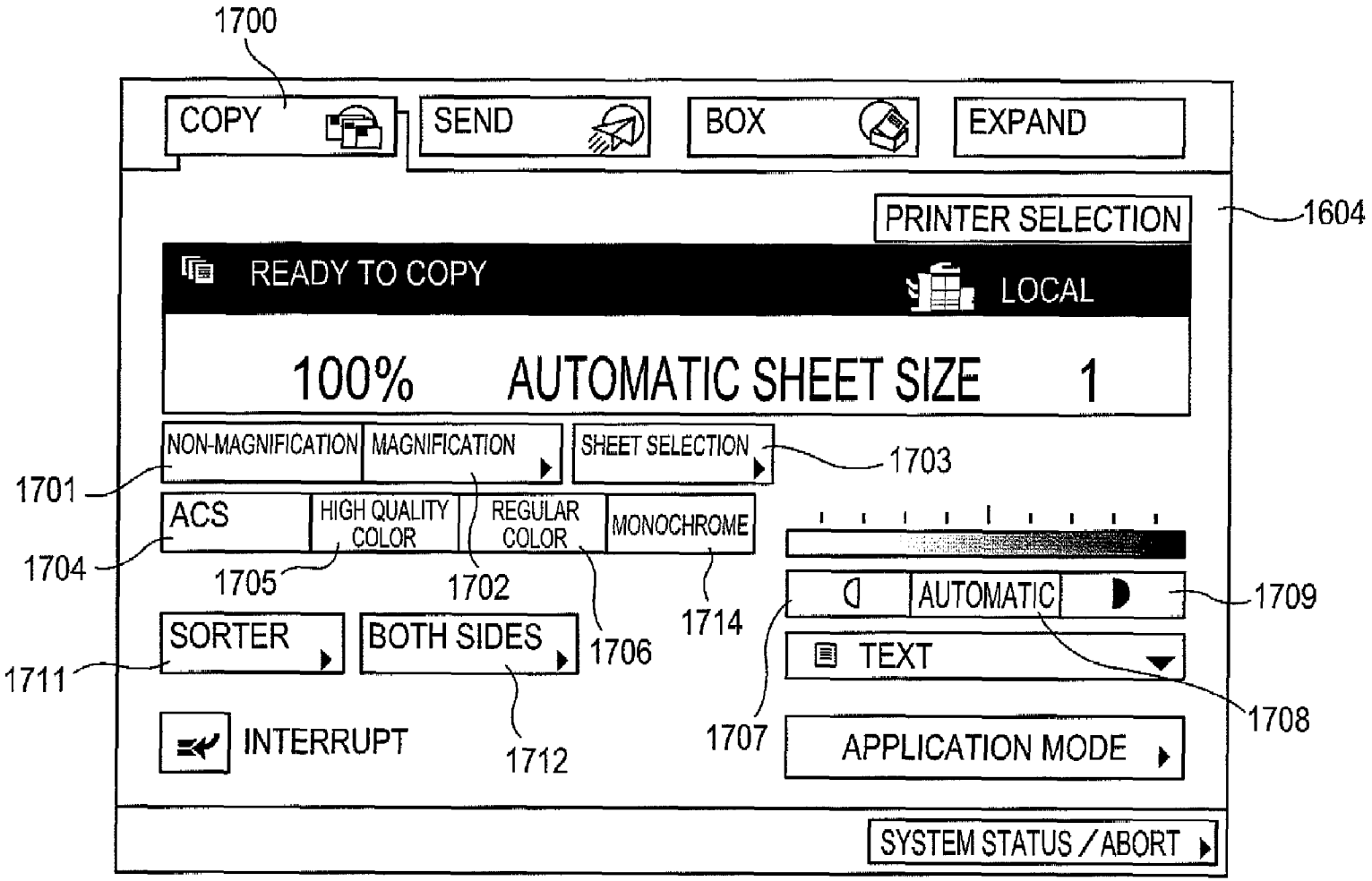
FIG. 17 illustrates a display screen of an operation panel at a normal state according to an embodiment.

FIG. 17 illustrates an exemplary display screen 1700 on the LCD 1604 in a normal state. In the screen 1700, buttons 1701 and 1702 are used to set the magnification of the image to be formed. A sheet selection button 1703 is used to select the size of a sheet of recording paper, such as various regular size sheets and irregular size sheets. Buttons 1704, 1705, 1706, and 1714 are used to select the ACS mode, the high quality color mode, the regular color mode, and the monochrome image forming mode, respectively. Only one of the buttons 1704, 1705, 1706, and 1714 can be selected, i.e., more than one button cannot be selected simultaneously. Buttons 1707, 1708, and 1709 are used to adjust the density of the printing of the image. A button 1711 is used to select a process, such as stapling, to be carried out on a stack of recording paper at an ejected paper processing apparatus (not shown in the drawings). A button 1712 is used when an image on a document is copied onto a sheet of recording paper to assign how the copied image will be arranged on the sheet with respect to the original image in the document, i.e., 'single side to single side' copy mode, 'single side to both sides' copy mode, 'both sides to single side' copy mode, or 'both sides to both sides' copy mode.

Figure 3:
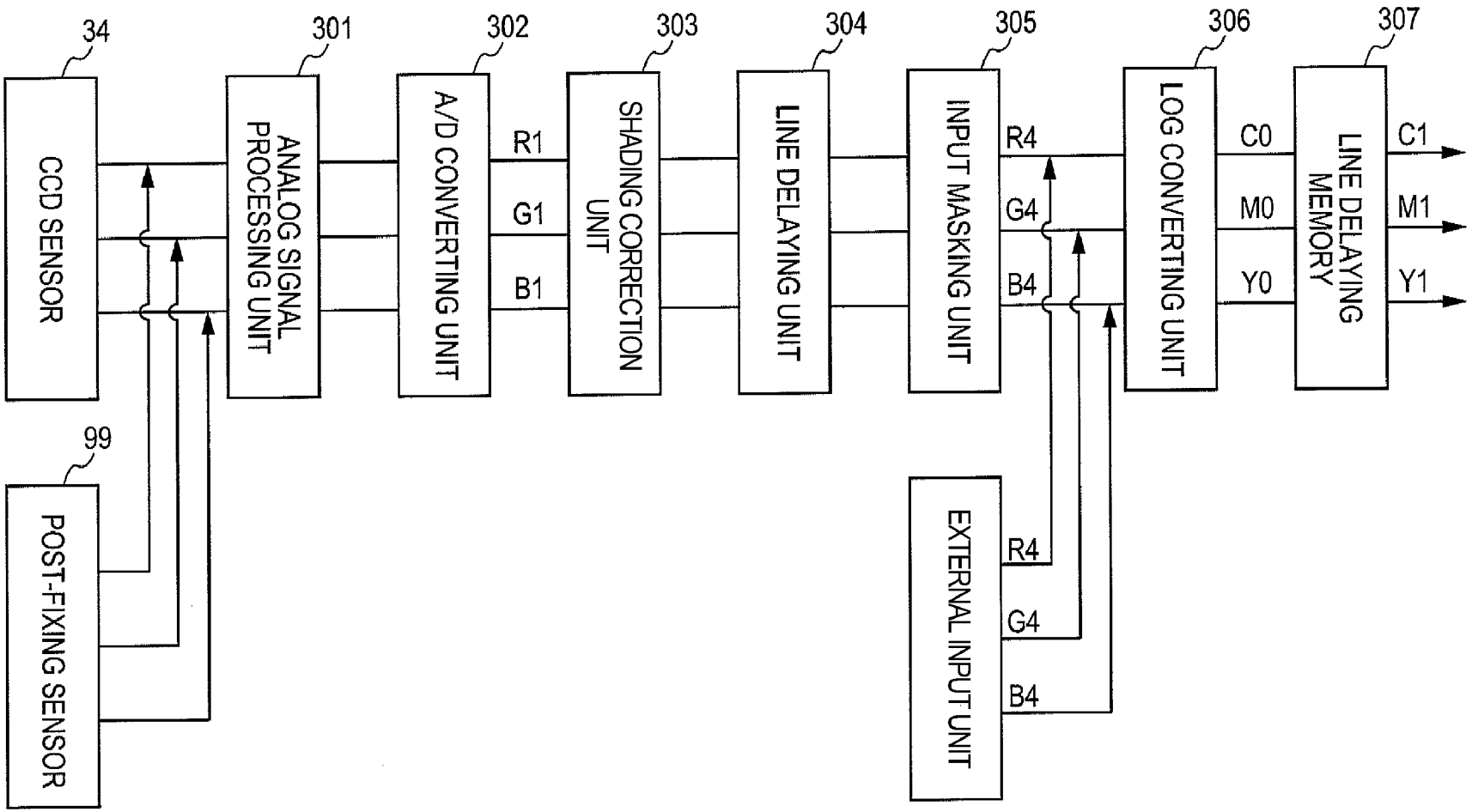
FIG. 3 is a block diagram showing the flow of image signals in an image processing unit in a reader unit according to an embodiment.

FIG. 3 is a block diagram showing the flow of image signals through image processing units of the reader unit 300 included in the color image forming apparatus 100, as shown in FIG. 1.

Output signals from a charge coupled device (CCD) sensor 34 and output signals from the post-fixing sensor 99 are input to an analog signal processing unit 301 where gain and the offset are adjusted. The signals are converted into 8-bit digital image signals R1, G1, and B1 at an analog/digital (A/D) converting unit 302. Then, the digital signals are input to a shading correction unit 303 where conventional shading correction is carried out using a signal read from a reference white plate for each color.

Since line sensors of the CCD sensor 34 are disposed predetermined distances apart from each other, the spatial displacement in the secondary scanning direction is corrected at a line delaying unit 304. An input masking unit 305 carries out 3×3 matrix computation to convert a color space defined by the spectral characteristics of red, green, and blue light read by the CCD sensor 34 into the National Television Standards Committee (NTSC) standard color space. A logarithmic (LOG) converting unit 306 functions as a light volume and density converting unit and includes a lookup table (LUT) RAM to convert R4, G4, and B4 luminance signals into density signals. Image signals cyan C0, magenta M0, and yellow Y0 output from the LOG converting unit 306 are sent to a line delaying memory 307 and are output to a printer control unit, shown in FIG. 4, as image signals C1, M1, and Y1. Hereinafter, 'C,' 'M,' 'Y,' and 'Bk' represent cyan, magenta, yellow, and black image signals, respectively. Image signals R4, G4, and B4 from an external input unit, shown in the drawing, are image signals sent from a computer or a facsimile.

Figure 4:
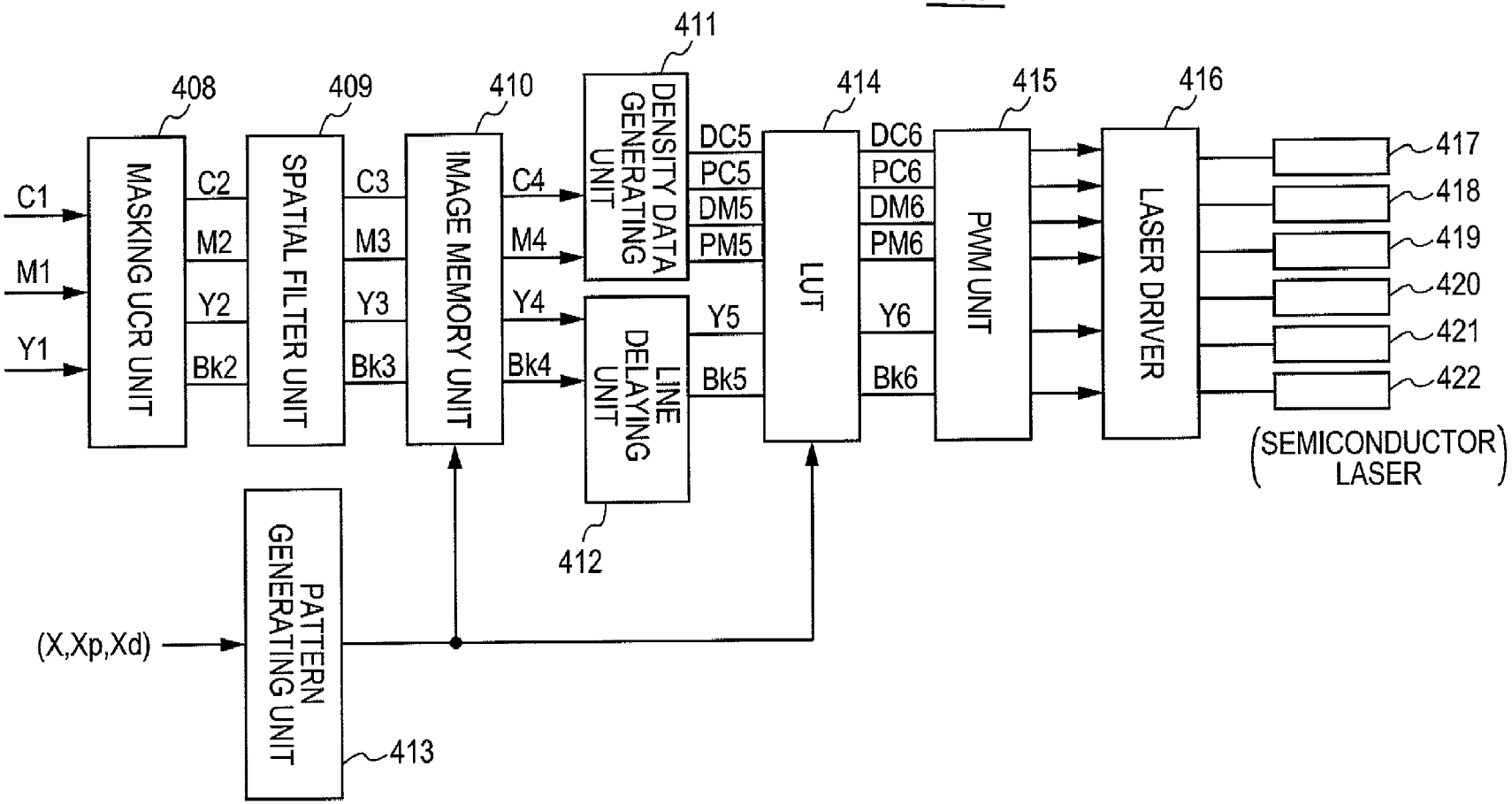
FIG. 4 is a block diagram showing the flow of image signals in a print control unit according to an embodiment.

FIG. 4 is a block diagram showing the flow of image signals through a printer control unit 400 controlling the color image forming apparatus 100, as shown in FIG. 1.

A masking and under color removal (UCR) unit 408 extracts a signal Bk for black from the signals Y1, M1, and C1 for the three primary colors. Then, calculation for compensating for the turbidity of the colorant used in the color image forming apparatus 100 is carried out, and outputting signals Y2, M2, C2, and Bk2 having a predetermined bit width (8 bits) are output in order each time a reading operation is carried out.

A spatial filter unit (output filter) 409 carries out edge reinforcement or smoothing. An image memory unit 410 temporarily stores signals Y3, M3, C3, and Bk3 from the spatial filter unit 409 after the above-described process is carried out and the signals are then sent to a density data generating unit 411 and a line delaying unit 412 in synchronization with the image forming operation.

The density data generating unit 411 converts image signals C4 and M4 into image signals DC5 and DM5 for dark cyan toner and dark magenta toner, respectively, and image signals PC5 and PM5 for light cyan toner and light magenta toner, respectively. This conversion process is carried out by using a predetermined conversion table. The structure of this predetermined conversion table is changed depending on whether the image data corresponds to a halftone image or a text image. More specifically, the proportion of image data corresponding to dark toner and image data corresponding to light toner is adjusted such that, for a halftone image, the amount of light toner used is increased to reduce the granulated effect in the highlighted area, whereas, for a text image, the amount of dark toner is increased to limit the amount of toner applied onto the recording material.

The line delaying unit 412 corrects the delay of the signals Y4 and Bk4 with respect to the signals DC5, PC5, DM5, and PM5 that are generated as a result of the data conversion carried out by the density data generating unit 411 so as to synchronize the image data sets corresponding to the six colors input to a LUT 414, as described below. The LUT 414 includes a γ table for light toner and a γ table for dark toner and carries out density correction (gradation correction) on the signals so that the image produced by the color image forming apparatus 100 will have optimal gradation characteristics. The image signals for the six colors (DC5, PC5, DM5, PM5, Y5, and Bk5) output from the density data generating unit 411 and the line delaying unit 412 are sent to the LUT 414 for gradation correction.

Signals DC6, PC6, DM6, PM6, Y6, and Bk6 output from the LUT 414 are sent in sequence to a PWM (pulse width modulation) unit 415. A laser driver 416 drives semiconductor lasers 417 to 422 (which are equivalent to the semiconductor laser 36 shown in FIG. 1) for the six colors so as to form latent images on the photosensitive drums 1*a* and 1*b*.

Figure 5:
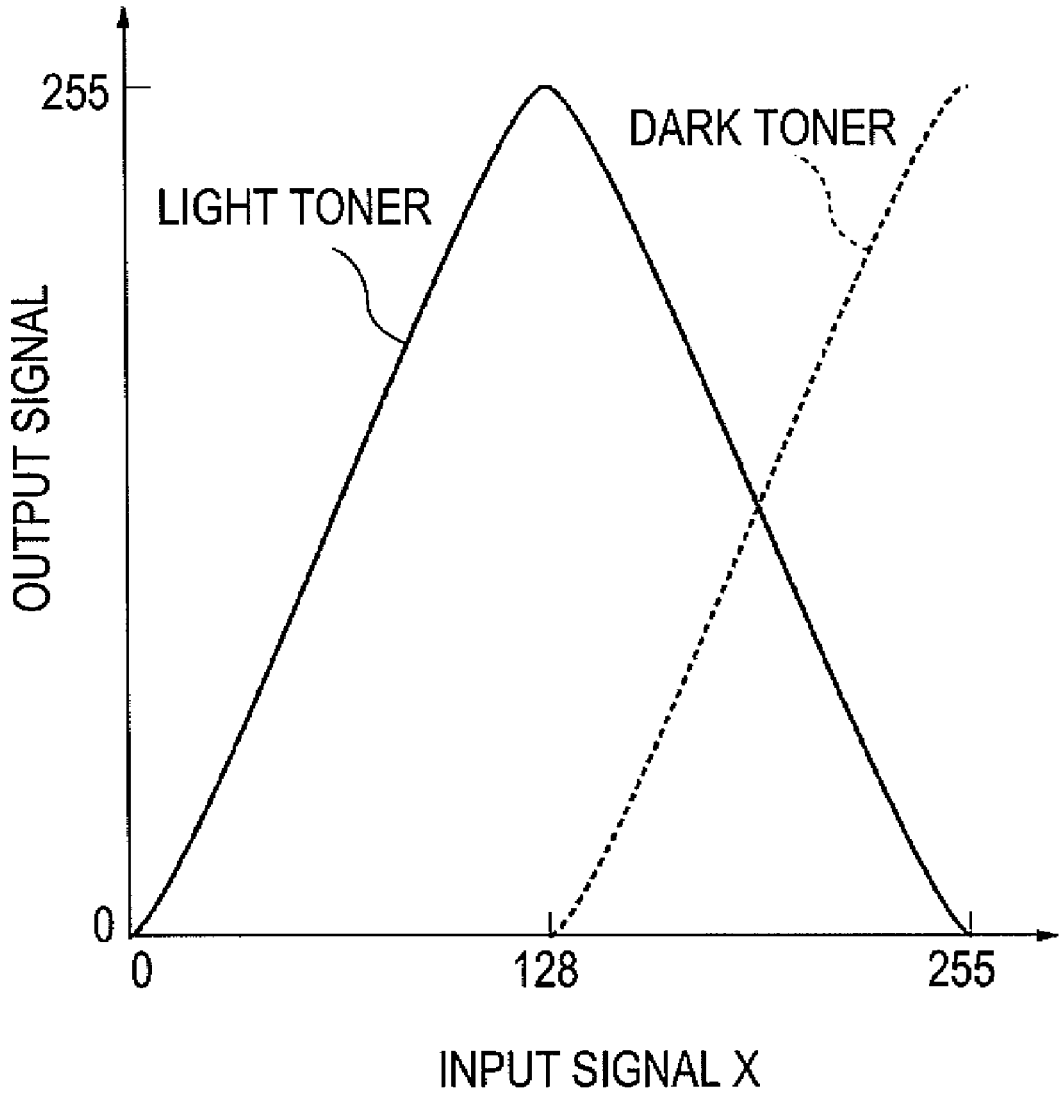
FIG. 5 is a graph showing the output characteristics of light and dark data generated in a light and dark data generating unit according to an embodiment.

FIG. 5 is a graph showing the output characteristics of the density data (an image signal for dark toner and an image signal for light toner) generated at the density data generating unit 411, shown in FIG. 4. The graph shows the relationship between input signals X (0 to 255) used for generating the density data input to the density data generating unit 411 and output signals output from the density data generating unit 411. Images corresponding to input signals X in the range of 0 to 128 are formed only with light toner, whereas images corresponding to input signals X in the range of 128 to 255 are formed with both light toner and dark toner wherein the amount of light toner used is gradually reduced while the amount of dark toner used is gradually increased as the input signal X approaches 255.

In this way, in response to the input signals X in the range of 0 to 128, the density data generating unit 411 outputs output signals 0 to 255 that correspond to only light toner, whereas, in response to the input signals X in the range of 128 to 255, the density data generating unit 411 outputs output signals 0 to 255 corresponding to both light and dark toners. Accordingly, for an input signal X=128, the input value and the output value for light toner are both 255 and the input value and the output value for dark toner are both 0.

Figures 6A, 6B:
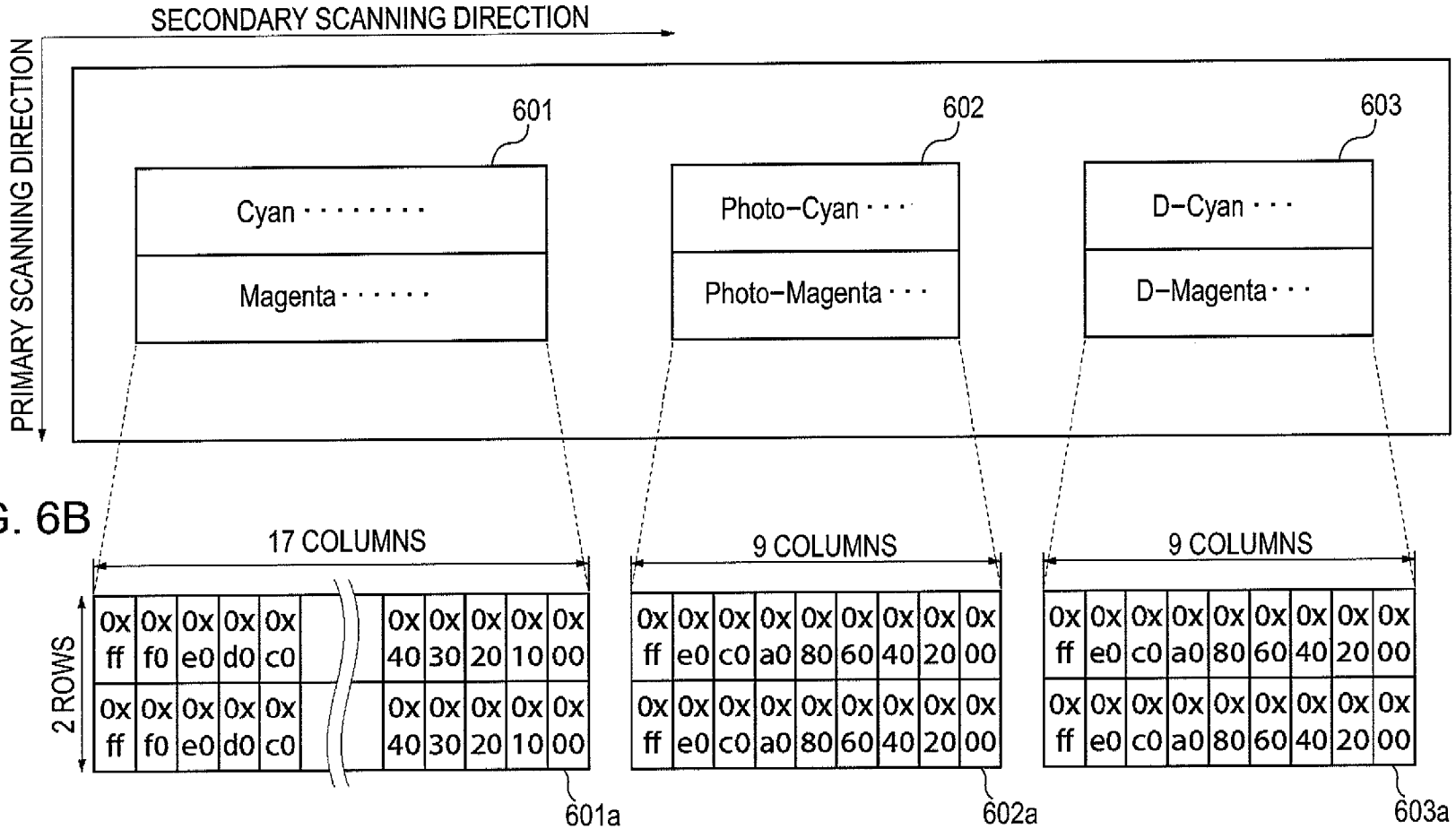
FIGS. 6A & 6B show a patch pattern used in a gradation correction process according to an embodiment.

The color image forming apparatus 100 according to this embodiment includes a pattern generating unit 413. The pattern generating unit 413 generates a first patch pattern 601 composed of dark and light magenta and dark and light cyan, a second patch pattern 602 composed of light cyan and light magenta, a third path pattern 603 composed of dark magenta and dark cyan on a sheet of recording paper, as illustrated in FIG. 6A. To produce these patterns, the pattern generating unit 413 stores first, second, and third pattern data sets 601*a*, 602*a*, and 603*a* corresponding to the first, second and third patch patterns 601, 602, and 603, respectively. The first, second, and third pattern data sets 601*a*, 602*a*, and 603*a* (shown in FIG. 6B) are output in response to input signals X, Xp, and Xd, respectively, input from an external device. The first, second and third patch patterns 601, 602, and 603, shown in FIG. 6A, may be formed on the same sheet or may be formed on separate sheets of recording paper.

The pattern data output from the pattern generating unit 413 can be sent to the PWM unit 415 via the image memory unit 410, the density data generating unit 411, and the line delaying unit 412 or can be sent directly to the PWM unit 415 via the LUT 414. In this way, the printer control unit 400, shown in FIG. 4, can output pattern data converted at the density data generating unit 411 and the LUT 414 and pattern data not converted at the density data generating unit 411 and the LUT 414.

The image signals DC6, PC6, DM6, PM6, Y6, and Bk6 processed at and output from the LUT 414 are sent through the PWM unit 415 and the laser driver 416 and are converted into laser beams at the semiconductor laser 417 to 422, respectively.

Method for Correcting Gradation According to this Embodiment

A process of correcting the gradation of light and dark cyan and light and dark magenta in the adjustment mode of the color image forming apparatus 100 having the above-described structure will be described below with reference to FIG. 7.

Figure 7:
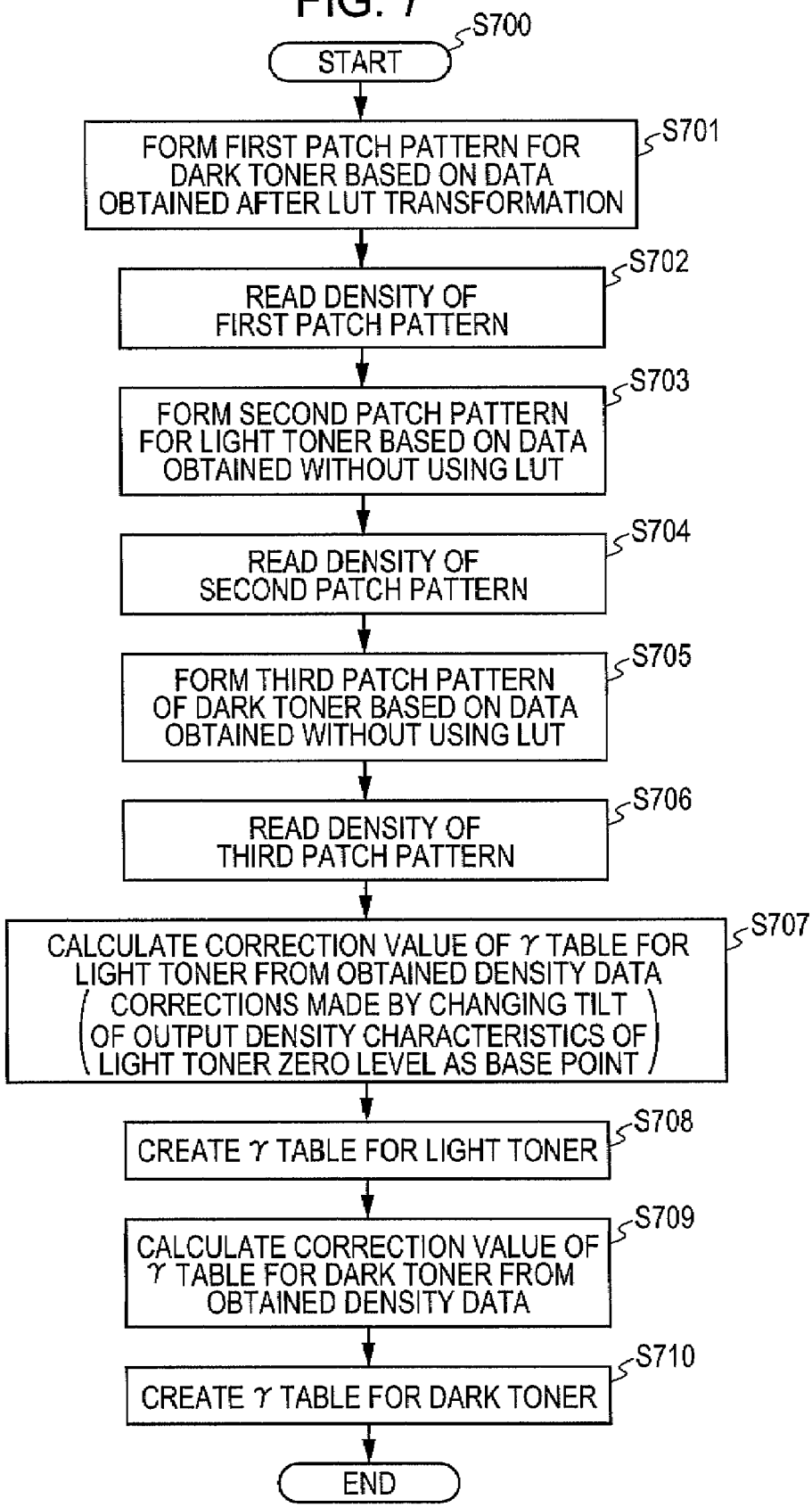
FIG. 7 is a flow chart of an adjusting mode according to an embodiment.

FIG. 7 is a flow chart showing a gradation correction process in the adjustment mode according to this embodiment.

The CPU 1506 controlling the overall operation of the color image forming apparatus 100 according to this embodiment carries out gradation control when the user carries out an operation to enter the adjustment mode. The color image forming apparatus 100 can enter the adjustment mode to carry out the gradation correction process at any time selected by the user, such as before, during, or after executing an image forming job.

The control unit 1501 receives instructions from the user to enter the adjustment mode to start the gradation correction process (Step S700).

I. Measurement of Difference ΔDn in Output Density (Steps S701 and S702)

The first pattern data set 601*a* is sent from the pattern generating unit 413 to the image memory unit 410. Accordingly, conversion data (i.e., image signals for dark and light toner) of the first pattern data set 601*a* is obtained via the density data generating unit 411 and the LUT 414 so as to form the first patch pattern 601 with light and dark toner on a sheet of recording paper, as shown in FIG. 6A (Step S701).

The first patch pattern 601 is a pattern composed of light and dark magenta toner and light and dark cyan toner. Seventeen points (17 gradation points) are taken from the 256-gradation input image signal at equal intervals to obtain an inputting input signal X (X=0, 16, 32, 48, 64, . . . , 255). This input signal X is sent to the pattern generating unit 413 to form the first patch pattern 601 on a sheet of recording paper. The first patch pattern 601 formed on the sheet is read at the post-fixing sensor 99 disposed downstream of the fixing unit 9 or at the CCD sensor 34 of the reader unit 300 by disposing the sheet on the document table glass of the reader unit 300 after the sheet is ejected into the ejection tray 89 (Step S702).

Figure 8:
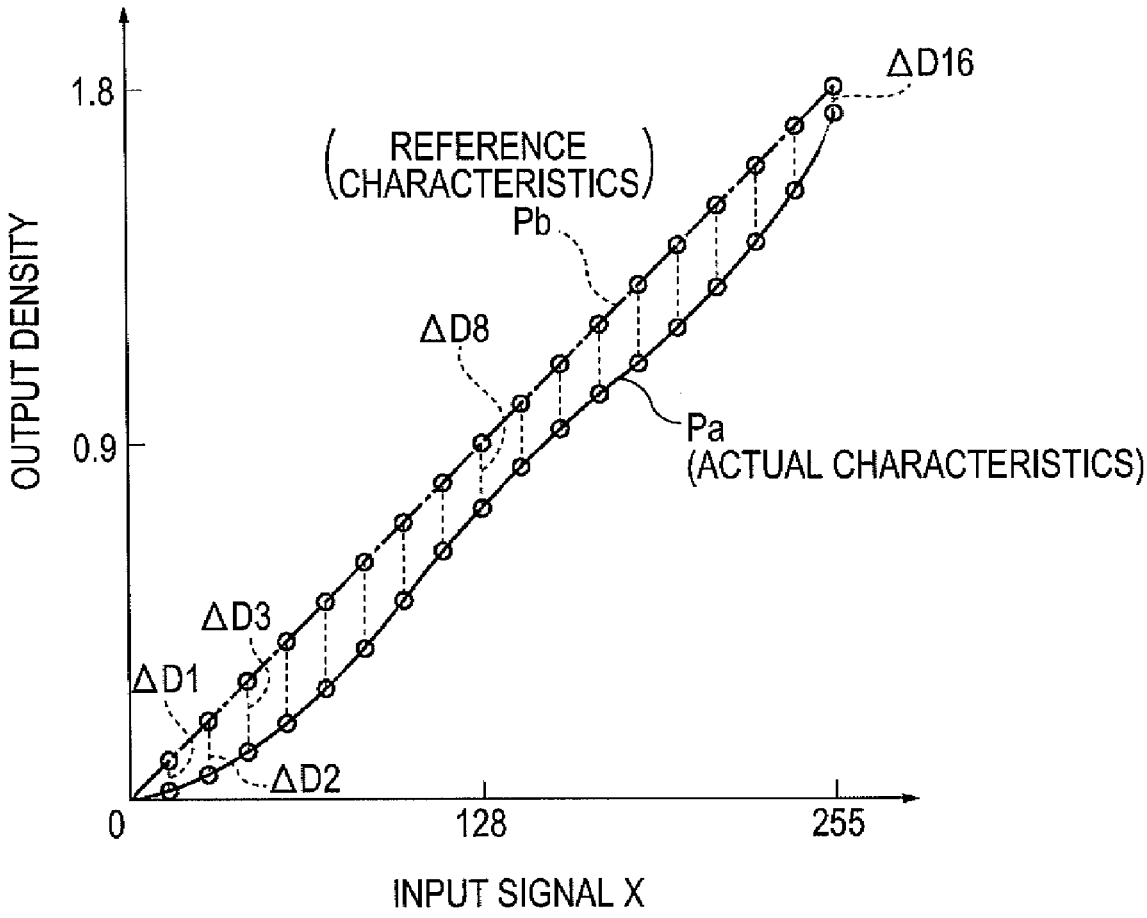
FIG. 8 is a graph showing the output density of dark and light toners corresponding to a dark toner input signal and a light toner input signal according to an embodiment.

FIG. 8 is a graph showing the output density of dark and light toners corresponding to the input signals X. The graph represents the output density characteristics determined by reading the first patch pattern 601.

A curved line Pa in FIG. 8 represents the actual output density corresponding to the input signal X, whereas a straight line Pb represents the reference output density, which are optimal values. The graph represents data obtained by carrying out interpolation on the 17 gradation points of the first patch pattern 601 to obtain data between the 17 points and then carrying out a smoothing process on the interpolated data. The graph represents the difference ΔDn (n=0 to 16) between the reference output density Pb for each of the 17 points and the actual output density.

A method for correcting the difference ΔDn between the actual output density and the reference output density by adjusting γ tables for light toner and dark toner will be described below.

II. Measurement of Output Density of Dark Toner and Light Toner (Steps S703 to S706)

To measure the output density of the light toner, the second pattern data set 602*a* for light toner is sent from the pattern generating unit 413 to the LUT 414. At this time, the second pattern data set 602*a* is output without passing through the density data generating unit 411 and the LUT 414 to form the second patch pattern 602 on a sheet of recording paper (Step S703).

The input signal Xp for forming the second patch pattern 602 for light toner includes nine points, Xp=0, 32, 64, 96, 128, . . . , 255, obtained on the basis of the output characteristics of the image signals for light toner, shown in FIG. 5, corresponding to the input signals X (X=0, 16, 32, 48, 64, . . . , 255) used to determine the output characteristics shown in FIG. 8. The second patch pattern 602 formed on a sheet of recording paper is read by the post-fixing sensor 99 or the CCD sensor 34 in a similar manner as the first patch pattern 601 (Step S704).

Subsequently, the third patch pattern 603 for dark toner is formed (Step S705) and read (Step S706) to measure the output density of the dark toner in the same manner as the second patch pattern 602 of the light toner. Here, the input signal Xd for forming the third patch pattern 603 for dark toner includes nine points, Xd=0, 32, 64, 96, . . . , 255, obtained on the basis of the output characteristics of the image signals for dark toner, shown in FIG. 5, corresponding to the input signals X (X=128, 144, 160, 176, . . . , 255) used to determine the output characteristics shown in FIG. 8.

III. Correction of γ Table for Light Toner (Steps S707 and S708)

Figure 9:
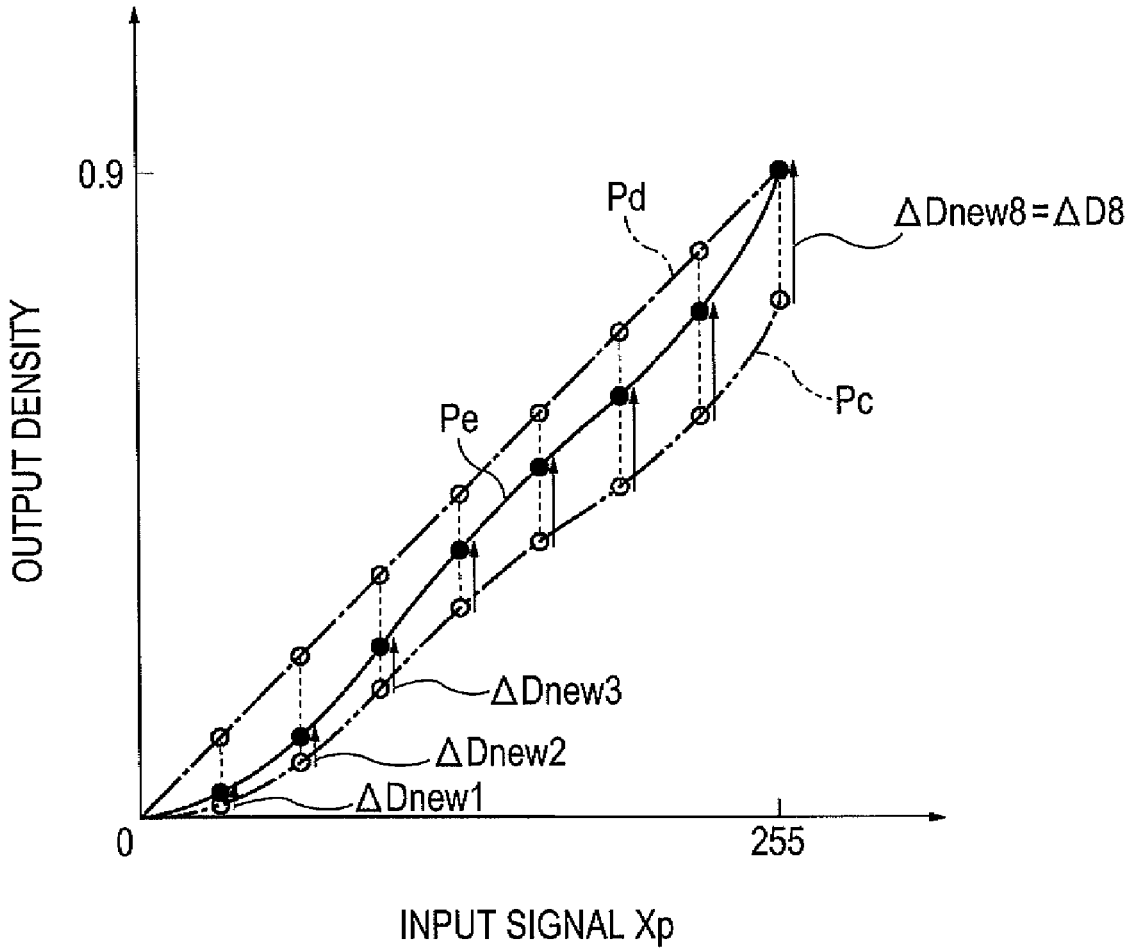
FIG. 9 is a graph showing a density gradient process of light toner according to an embodiment.
Figure 10:
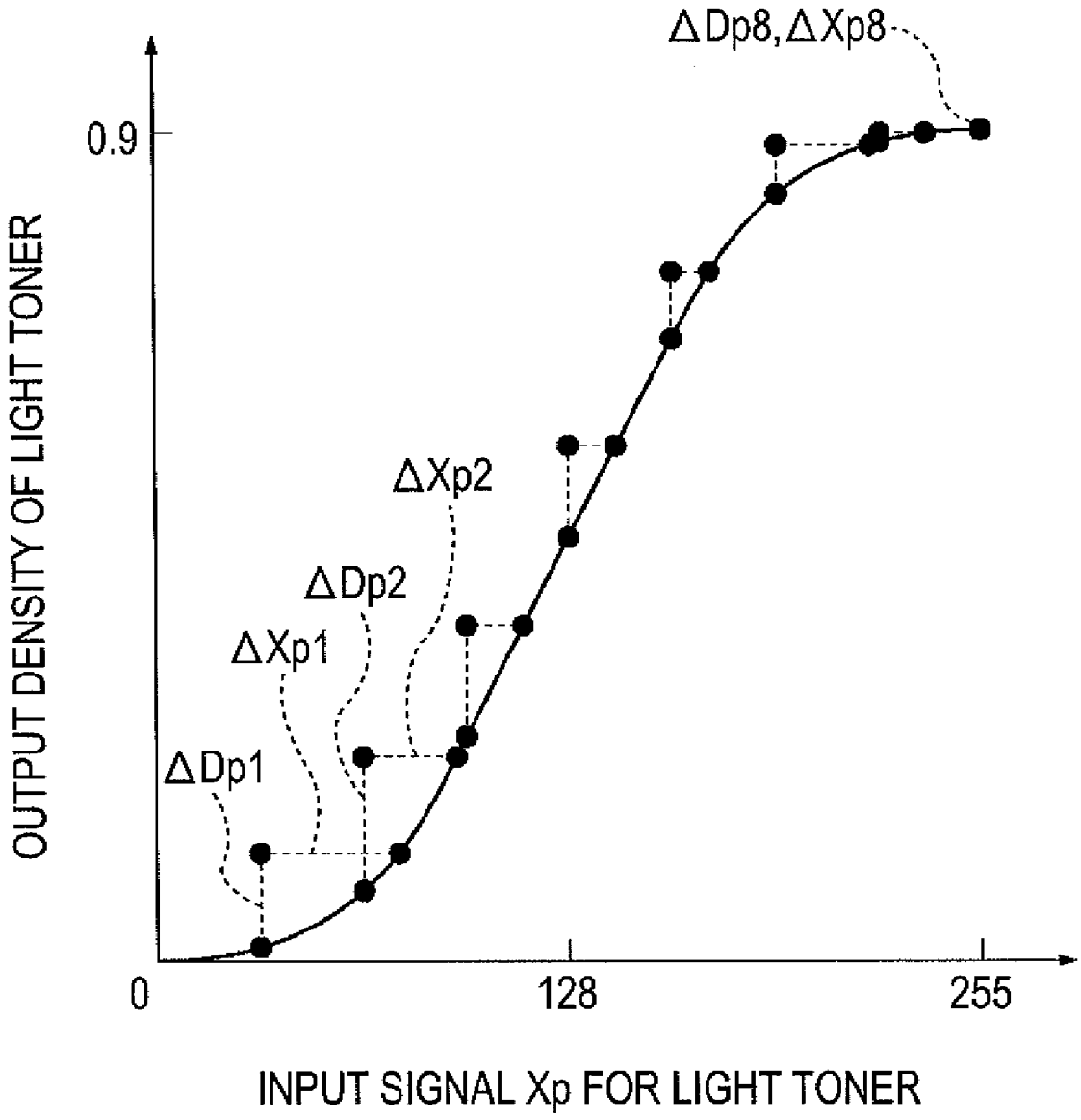
FIG. 10 is a graph showing a correction process for an output density of light toner corresponding to a light toner input signal according to an embodiment.

A method for correcting the γ table for light toner to correct the output density corresponding to the input signal X (X=0 to 128) will be described with reference to FIGS. 9 and 10. FIG. 9 is a graph illustrating the method for processing slope of the light toner density according to this embodiment. FIG. 10 is a graph illustrating the correction process of output density of light toner corresponding to the input signal Xp for light toner.

As shown in FIG. 9, a curved line Pc represents the output density of light toner obtained by reading the second patch pattern 602, and a straight line Pd represents the reference output density. In the color image forming apparatus 100 according to this embodiment, the maximum density of the light toner is adjusted to 0.9. This value is determined on the basis of a case in which the position for switching the proportions of the light toner to be used and the dark toner to be used when half of the maximum density is reached.

As shown in FIG. 5, in the ranges where the input signal X equals 0 to 128, the output image is produced only with light toner. Therefore, the density correction value ΔDpn for light toner is equal to the output density difference ΔDn (n=0 to 8). The color image forming apparatus 100 according to this embodiment can prevent the areas in the vicinity of the borders of the light toner areas and the halftone areas, where a mixture of light toner and dark toner is used, from exhibiting a significant density difference. In particular, the color image forming apparatus 100 according to this embodiment can prevent the area in the vicinity of the area corresponding to the input signal X=128 from exhibiting a significant density difference by controlling the density correction value ΔDp8 and the output density difference ΔD8 so that their difference equals zero.

According to the output density characteristics for light toner represented by the graph in FIG. 9, the slope of the density curve shown in FIG. 9 is moved in a vertical direction until the density level of ΔDp8 equals zero so that the density difference of ΔDp8 and ΔD8 equals zero, where the point where the input signal Xp equals zero (output density D=0) is the base point (i.e., as shown in FIG. 9, the points represented by circles on the curved line Pc (dotted line) are corrected to the points represented by black circles on the curved line Pe (solid line)).

By moving the density curve, the output density values corresponding to input signal X (X=0 to 128) except for the values corresponding to X=0 and X=128 are changed. Therefore, the previously-obtained output density values ΔDn (n=1 to 7) are replaced with the difference ΔDnew(n) between the output density value ΔDn and the output density value after being changed. Moreover, to correct the difference ΔDnew (n), input signal correction value ΔXpn (n=1 to 7) is obtained by multiplying the difference ΔDnew(n) by an inverse function, as shown in FIG. 10.

The corrected value ΔXpn (n=1 to 7) is obtained to prevent the halftone areas of the image from exhibiting a significant difference in density. Therefore, density correction does not have to be carried out precisely for the input signal X other than the input signal X corresponding to 0 to 128 (0<x<128). When carrying out density correction precisely for the input signal X corresponding to 0<x<128, the difference between the previously-obtained output density value ΔDn (n=1 to 7) and the value obtained after the density curve is moved is calculated, and then the corrected value ΔXpn (n=1 to 7) is calculated (Step S707).

Figure 11:
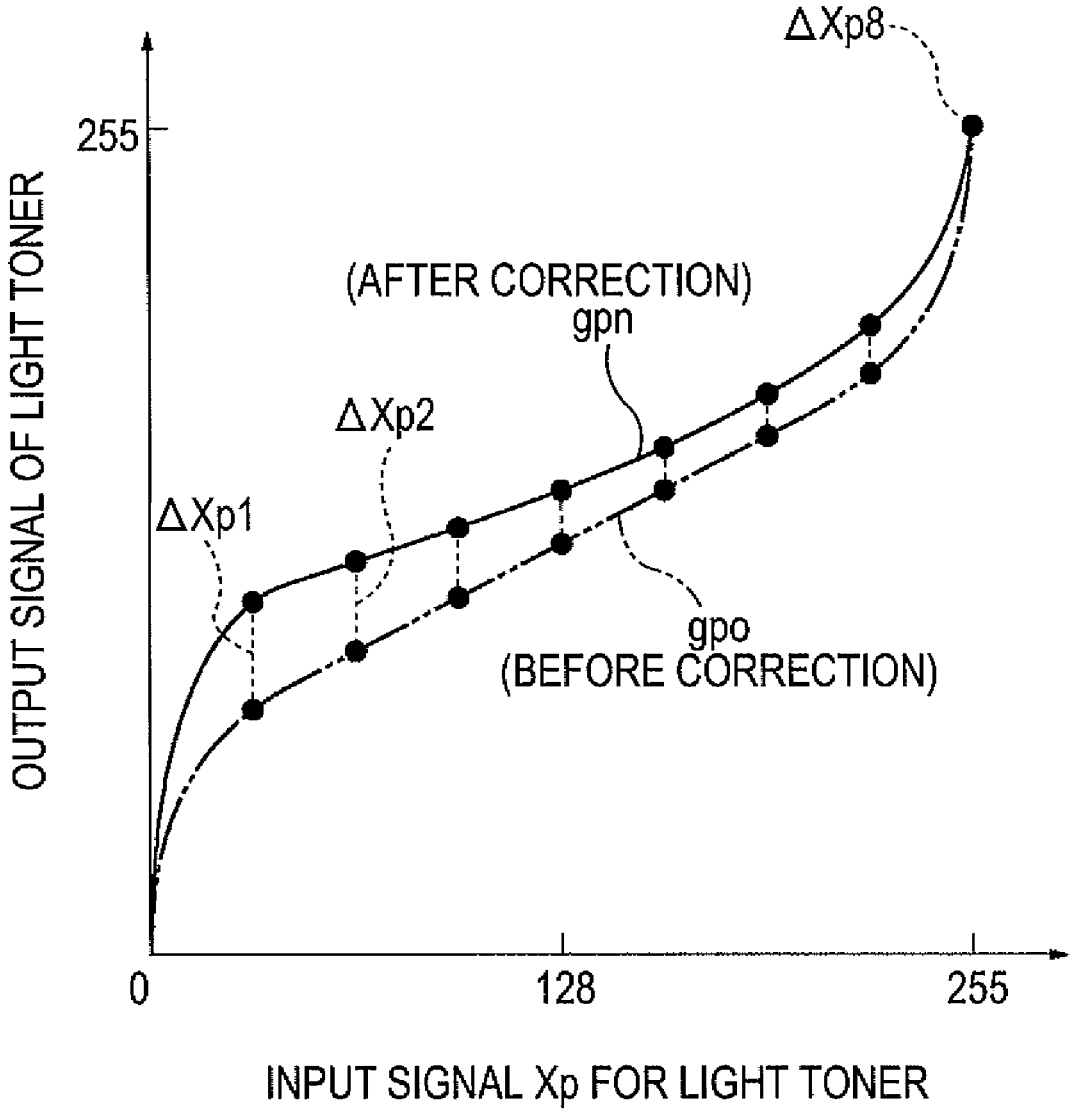
FIG. 11 is a graph showing a γ table for light toner representing states before and after correction according to an embodiment.

FIG. 11 is a graph showing the γ table for light toner before and after correction. In FIG. 11, the γ table before correction is represented by a dotted curved line gpo, and the γ table after correction is represented by a solid curved line gpn. The γ table gpn represented by the solid curved line is obtained by correcting the previously-obtained input signal correction value ΔXpn (n=0 to 8) at nine points corresponding to the input signal Xp (Xp=0, 32, 64, 96, 128, . . . , 255) and by carrying out interpolation on the nine points to obtain data between the nine points and then carrying out a smoothing process on the interpolated data (Step S708).

By replacing the γ table gpo with the new γ table gpn, the change in density at the area in the vicinity of an area corresponding to the input signal X=128 (where the light toner area meets the halftone area) is corrected, and, thus, the image quality is improved.

IV. Correction of γ Table for Dark Toner (Steps S709 and S710)

Figure 12:
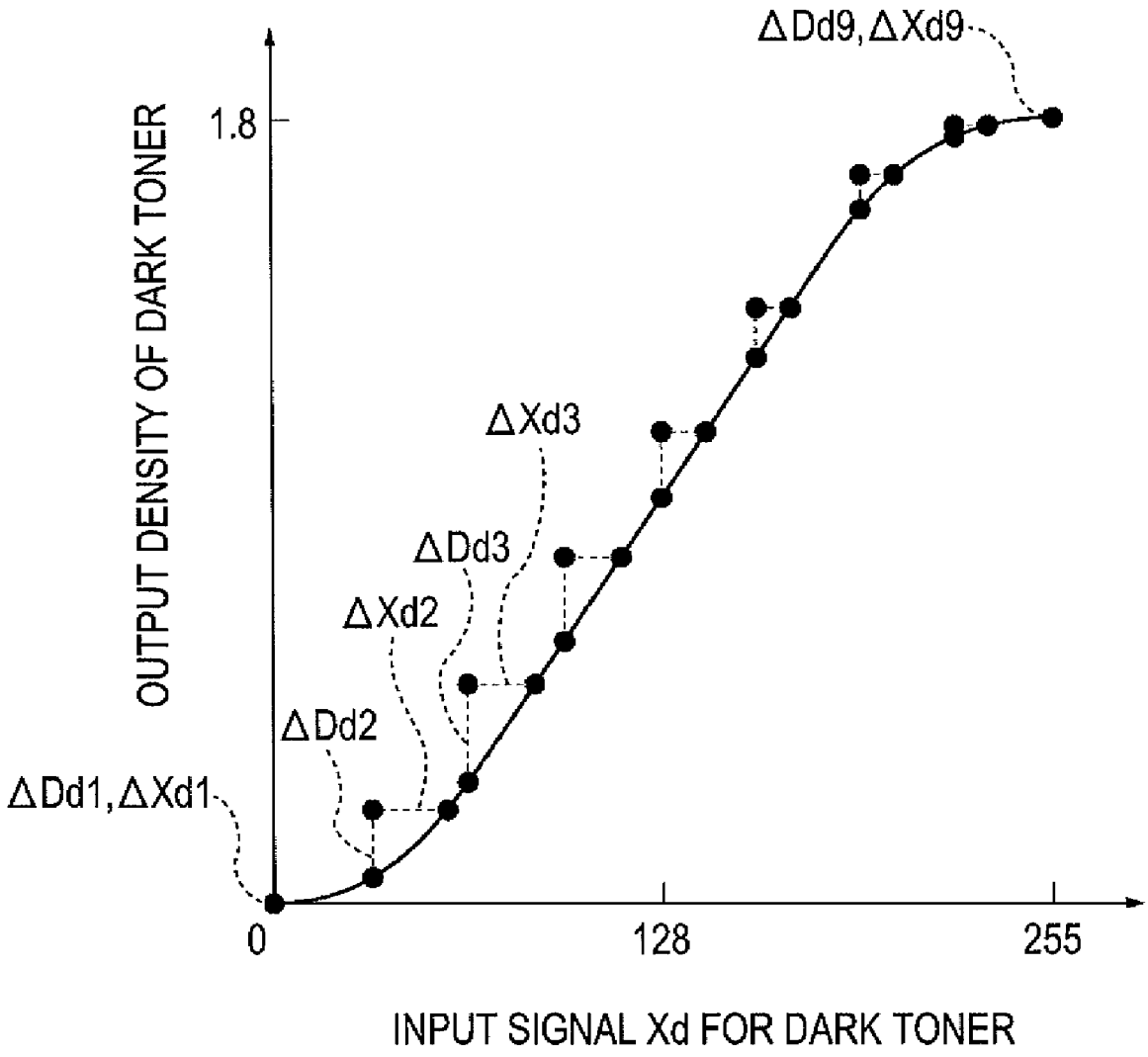
FIG. 12 is a graph showing the output density of dark toner corresponding to a dark toner input signal according to an embodiment.

Next, a method for correcting the γ table for dark toner to correct the output density corresponding to the input signal X (X=128 to 255) will be described with reference to FIG. 12. FIG. 12 is a graph showing the output density of dark toner corresponding to the input signal Xd for dark toner and shows the output density characteristics of a dark toner determined by reading the third patch pattern 603 formed on a sheet of recording paper.

Since images are formed with both light and dark toners, as shown in FIG. 5 in the area corresponding to the input signal X (X=128 to 255), to correct gradation in this area using a γ table for dark toner, the density correction carried out by the γ table gpn for light toner, obtained above, should be taken into consideration. Since the output density of light toner is distributed symmetric on both sides of the line corresponding to the input signal X=128, as shown in FIG. 5, the density correction value ΔDdm can be calculated as:

$$\Delta Ddm=\Delta D(7+m)-\Delta D(9-m)\ (m=1\text{ to }9),$$

where ΔDdm is the density correction value for dark toner, ΔD(7+m) is the density correction value ΔDn (n=8 to 16) for the intermediate to high density areas, and ΔD(9−m) is the density correction value that is corrected by the γ table gpn for light toner.

By using the density correction value ΔDdm obtained as described above, the input signal correction value ΔXdm (m=1 to 9) corresponding to predetermined points is obtained from the output density characteristics shown in FIG. 12 (Step S709).

Figure 13:
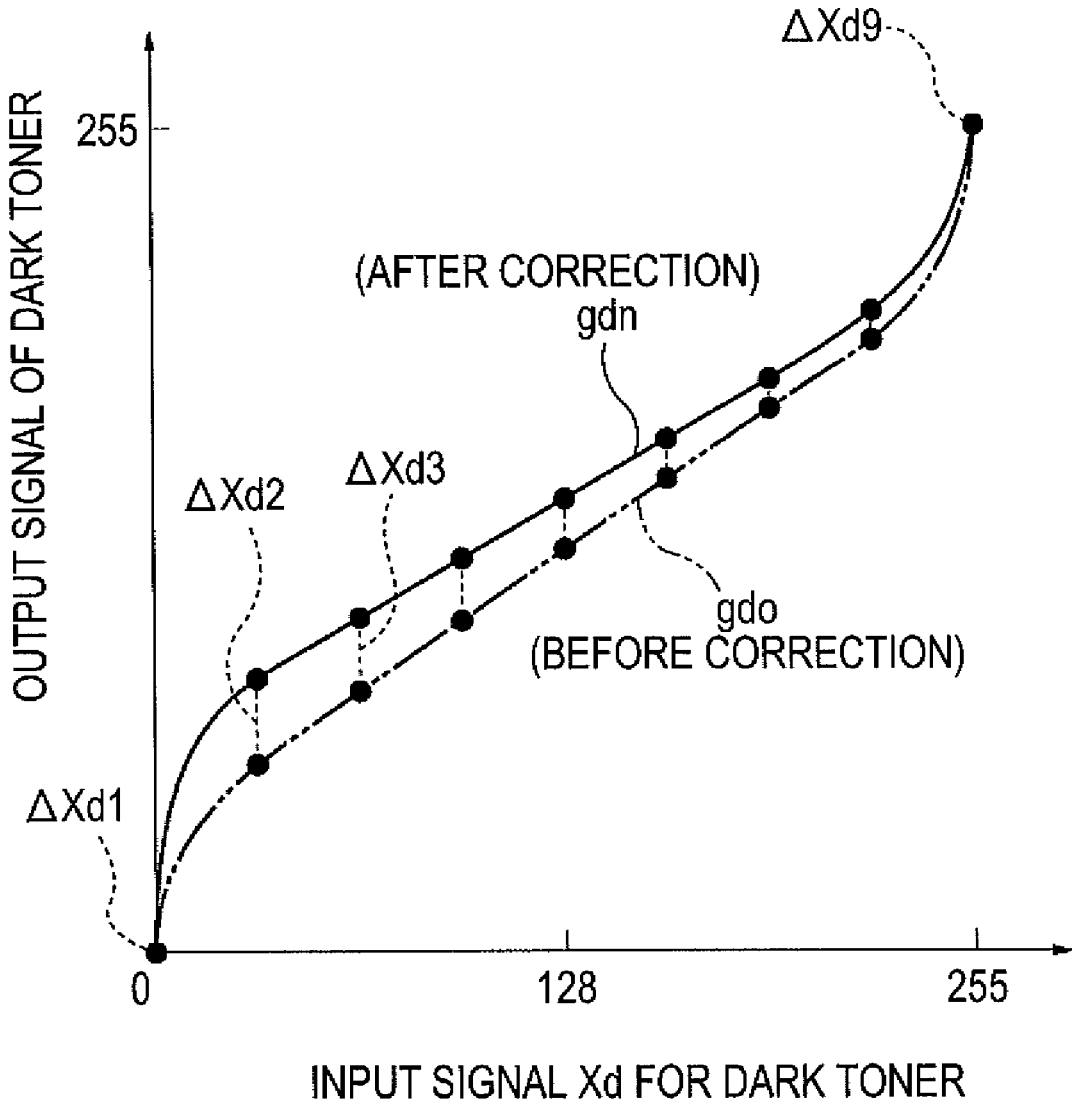
FIG. 13 is a graph showing a γ table for dark toner representing states before and after correction according to an embodiment.

FIG. 13 is a graph showing the γ table for dark toner before and after correction. In FIG. 13, the γ table before correction is represented by a dotted curved line gdo, and the γ table after correction is represented by a solid curved line gdn. In FIG. 13, the γ table gdn represented by the solid curved line is obtained by correcting the previously-obtained input signal correction value ΔXdm (m=1 to 8) at eight points corresponding to the input signal Xp (Xp=0, 32, 64, . . . , 255) and by carrying out interpolation on the eight points to obtain data between the eight points and then carrying out a smoothing process on the interpolated data. By replacing the γ table gdo with the γ table gdn, the intermediate to high density areas corresponding to the input image signal X=128 to 255 are corrected, and, thus, the gradation is improved (Steps S710).

As described above, according to this embodiment, patch patterns produced with dark and light toners are read. Then, a γ table for controlling the gradation of the light and dark toners is corrected in accordance with the gradation characteristics of the density of the patch pattern. At this time, the gradation characteristics of the light toner is corrected by changing the slope of the gradation characteristics of light toner so that predetermined output characteristics are obtained. In this way, the border areas of dark toner and light toner are prevented from exhibiting a significant difference in densities. As a result, generation of false outlines in the halftone areas can be prevented, and high quality images can be output stably and steadily.

Since the color image forming apparatus 100 according to this embodiment is capable of preventing the border areas around the halftone area from exhibiting a significant density difference, for the areas other than areas corresponding to where the input signal X equals 0 to 128 (0<X<128), density correction can be carried out easily.

Other Embodiments

In the first patch pattern 601 according to the above-described embodiment, the output density is measured using a pattern including 17 points (17 gradation points) obtained by dividing the 256-gradation input image signal at equal intervals. The number of points (gradation points) may be increased or the intervals of the points may be changed in accordance with the output characteristics of the image forming apparatus so as to improve the efficiency of the gradation correction according to an embodiment.

For an image forming apparatus configured to form images by changing the resolution in accordance with the image to be formed, patterns having various resolutions may be produced to carry out the gradation correction according to an embodiment. In this way, even if the difference in resolution causes a significant difference in the gradation characteristics, high quality images can be produced stably.

According to the above-described embodiment, density correction of the light toner is performed by changing the slope of the light toner with zero level as a base point so that the input signal X=128 corresponding to an area where the dark toner and the light toner are mixed is set at a predetermined level. In this way, generation of false outlines in the halftone area can be prevented. For the dark toner, density correction is performed by changing the slope of the density with the maximum density (1.8 according to the above-described embodiment) set as a base point. Then, after density correction for the dark toner is performed, the density correction for the light toner can be performed. In such a case, the process of the density correction for the dark toner performed by changing the slope of the density is the same as the process of the density correction for the light toner according to the above-described embodiment, except that the base point is the maximum density value Dmax rather than zero level.

Figure 14:
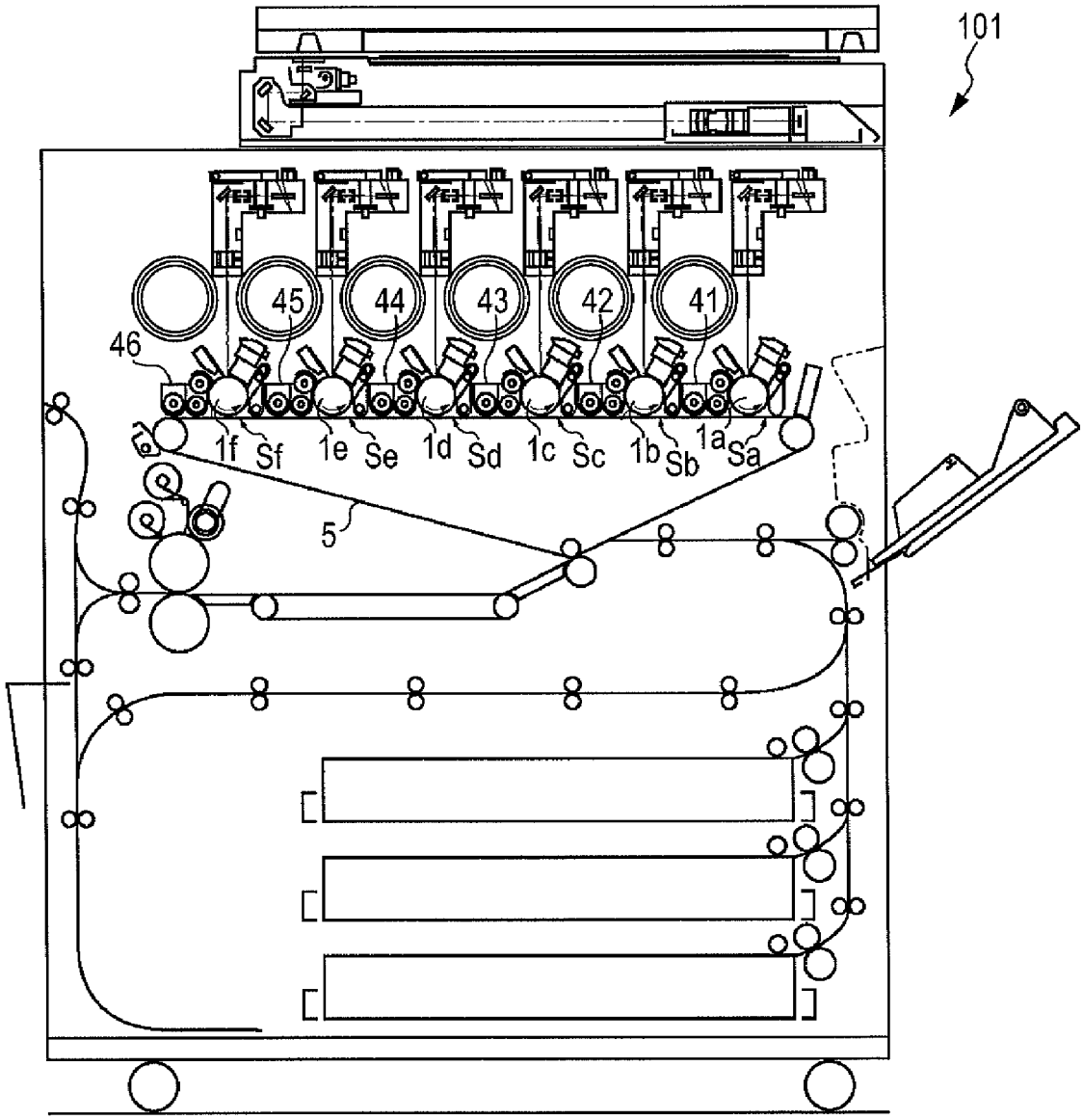
FIG. 14 is a plan view showing the structure of a tandem type image forming apparatus.

FIG. 14 is a plan view of the overall structure of a tandem type image forming apparatus.

A tandem type image forming apparatus 101 is configured to form images using image bearing members (photosensitive bodies) corresponding to the numbers of toners used. The tandem type image forming apparatus 101 includes six image bearing members 1*a*, 1*b*, 1*c*, 1*d*, 1*e*, and if. The image bearing members 1*a*, 1*b*, 1*c*, 1*d*, 1*e*, and 1*f* include developing units 41, 42, 43, 44, 45, and 46, respectively. The developing units 41, 42, 43, 44, 45, and 46 contain developers having different spectral characteristics. Image forming units Sa, Sb, Sc, Sd, Se, and Sf, each including a pair of one image bearing member and one developing unit, are aligned in a line.

Such a tandem type image forming apparatus, compared with a known six-color image forming apparatus, is capable of outputting images at the same output speed. In this way, productivity is improved.

Accordingly, degradation in the gradation caused by a change in the image output characteristics of the dark and light toners is corrected and generation of false outlines in the halftone area can be prevented. As a result, high quality images can be produced steadily and stably.

The image forming apparatus capable of changing the resolution in accordance with the image to be produced may produce patterns having various resolutions for carrying out gradation correction. In this way, even if the difference in resolution causes a significant difference in the gradation characteristics, high quality images can be stably produced.

Embodiments of the present invention are not limited to those apparatuses described above and may include systems constituted of a plurality of devices or an apparatus constituted of one unit. A computer (central processing unit (CPU) or micro processing unit (MPU)) included in the system or the apparatus may read out program code to realize the functions according to the above-described embodiments.

The recording medium used to supply the program code may be, for example, a flexible disk, a hard disk, an optical disk, a magnetic optical disk, a compact disk read only memory (CD-ROM), a CD-Recordable (CD-R), a magnetic tape, a non-volatile memory card, and a non-volatile memory. Another embodiment of the present invention may be realized by entirely or partially carrying out the actual processing by an operating system (OS) operating on the computer in accordance with the program code to perform the functions of the above-described embodiments.

Another embodiment of the present invention includes the steps of realizing the functions according to the above-described embodiments by executing the program code written in the memory included in a function expansion board mounted in the computer or a function expansion unit connected to the computer. More specifically, an embodiment of the present invention may be realized by entirely or partially carrying out the actual processing by a CPU included in the function expansion board or the function expansion unit in accordance with the program code.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. An image forming apparatus configured to form an image corresponding to an input signal which is less than or equal to a predetermined value using a light toner, and to form an image corresponding to an input signal which is more than the predetermined value using the light toner and a dark toner, the light toner and the dark toner having a same hue and a density of the dark toner being higher than that of the light toner, the image forming apparatus comprising:

an image forming unit configured to form an image on a recording material using the light toner or the dark toner;

a control unit configured to cause the image forming unit to form a pattern having a gradation on the recording material;

a reading unit configured to read the pattern on the recording material;

a detecting unit configured to detect a density of the pattern based on the result of the reading unit;

a determining unit configured to determine whether a density difference between a reference density and a density of an image only with the light toner based on an input signal corresponding to the predetermined value exists;

a correcting unit configured to correct a slope of a characteristic of image density detected by the detection, so that the density difference equals zero, the correcting unit corrects the slope on an input signal to a zero level as a base point; and an updating unit configured to update a gradation correcting date to correct a gradation characteristic of an image formed only with the light toner based on the result of correction by the correcting unit.

* * * * *